US011471923B2

(12) United States Patent
Yamane et al.

(10) Patent No.: US 11,471,923 B2
(45) Date of Patent: Oct. 18, 2022

(54) PRODUCTION METHOD OF SEAMLESS STEEL PIPE

(71) Applicant: NIPPON STEEL CORPORATION, Tokyo (JP)

(72) Inventors: Kouji Yamane, Tokyo (JP); Kazuhiro Shimoda, Tokyo (JP); Yuji Arai, Tokyo (JP); Akihiro Sakamoto, Tokyo (JP); Yasuhiko Daimon, Tokyo (JP); Haruka Obe, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 313 days.

(21) Appl. No.: 16/761,640

(22) PCT Filed: Nov. 28, 2018

(86) PCT No.: PCT/JP2018/043783
§ 371 (c)(1),
(2) Date: May 5, 2020

(87) PCT Pub. No.: WO2019/107409
PCT Pub. Date: Jun. 6, 2019

(65) Prior Publication Data

US 2020/0384514 A1 Dec. 10, 2020

(30) Foreign Application Priority Data

Nov. 29, 2017 (JP) ..... JP2017-228498

(51) Int. Cl.
*B21B 19/04* (2006.01)
*C21D 9/08* (2006.01)
(Continued)

(52) U.S. Cl.
CPC ..... *B21B 19/04* (2013.01); *C21D 6/002* (2013.01); *C21D 6/008* (2013.01); *C21D 8/105* (2013.01); *C21D 9/085* (2013.01); *C22C 38/32* (2013.01)

(58) Field of Classification Search
CPC .. B21B 19/04; B21B 2045/0227; B21B 37/74
See application file for complete search history.

(56) References Cited

U.S. PATENT DOCUMENTS

| | | | |
|---|---|---|---|
| 3,782,160 | A | 1/1974 | Kheifets et al. |
| 2002/0116971 | A1 | 8/2002 | Roller |
| 2019/0300979 | A1 | 10/2019 | Soma et al. |

FOREIGN PATENT DOCUMENTS

| | | | |
|---|---|---|---|
| CN | 1370640 | A | 9/2002 |
| CN | 1502425 | A | 6/2004 |

(Continued)

OTHER PUBLICATIONS

Int'l. Search Report issued in PCT/JP2018/043783, dated Dec. 25, 2018.

(Continued)

*Primary Examiner* — Jenny R Wu
(74) *Attorney, Agent, or Firm* — Greer, Burns & Crain, Ltd.

(57) ABSTRACT

The production method of a seamless steel pipe includes a heating step of heating an Nb-containing steel material to 800 to 1030° C., a pipe-making step of producing a hollow shell by performing piercing-rolling or elongation-rolling on the Nb-containing steel material, by using a piercing mill including a plurality of skewed rolls, a plug disposed between the plurality of skewed rolls, and a mandrel bar, and a cooling step immediately after rolling, of carrying out cooling using a cooling liquid on a hollow shell portion that passes between rear ends of the plurality of skewed rolls, in the hollow shell, so as to reduce an outer surface temperature (Continued)

of the hollow shell portion to 700 to 1000° C. within 15.0 seconds after the hollow shell portion passes between the rear ends of the plurality of skewed rolls.

12 Claims, 19 Drawing Sheets

(51) Int. Cl.

| | |
|---|---|
| *C22C 38/32* | (2006.01) |
| *C21D 6/00* | (2006.01) |
| *C21D 8/10* | (2006.01) |

(56) References Cited

FOREIGN PATENT DOCUMENTS

| | | | | |
|---|---|---|---|---|
| CN | 101850364 | A | | 10/2010 |
| DE | 2054528 | A1 | | 5/1972 |
| DE | 0067906 | A2 | * | 12/1982 |
| EP | 0067906 | A2 | | 12/1982 |
| JP | 2007031756 | A | | 2/2007 |
| WO | 2017200033 | A1 | | 11/2017 |

OTHER PUBLICATIONS

Hata et al.; "Development of a Reconstruction Method for Prior Austentite Microstructure Using EBSD Data of Ferrite Microstructure", Technical Report of Nippon Steel & Sumitomo Metal Corporation, No. 404 (2016) pp. 24-30.

* cited by examiner

Billet Heating Temperature
And
Processing-incurred Heat Temperature Increase Amount (°C)

PRODUCTION METHOD OF SEAMLESS STEEL PIPE

This is a National Phase Application filed under 35 U.S.C. § 371, of International Application No. PCT/JP2018/043783, filed Nov. 28, 2018, the contents of which are incorporated by reference.

TECHNICAL FIELD

The present disclosure relates to a production method of a seamless steel pipe.

BACKGROUND ART

With the depletion of wells with low corrosivity (oil wells and gas wells), wells with high corrosivity (hereinafter, referred to as highly corrosive wells) is being developed. The environment of a highly corrosive well contains a large amount of corrosive substances, and a temperature of the highly corrosive well is a room temperature to approximately 200° C. The corrosive substances include, for example, corrosive gas such as a hydrogen sulfide. A hydrogen sulfide causes sulfide stress cracking (Sulfide Stress Cracking, hereinafter referred to as "SSC") in oil country tubular goods including a low alloy seamless steel pipe with high strength. Therefore, in the seamless steel pipes that are used in these highly corrosive wells are required to have high SSC resistance.

On the other hand, the oil country tubular goods that are used in the aforementioned highly corrosive wells are also required to have high strength. However, SSC resistance and strength are contradictory characteristics in general. Consequently, as the strength of a seamless steel pipe is increased, SSC resistance of the seamless steel pipe decreases.

In order to have high strength and obtain excellent SSC resistance, refinement of crystal grains is effective. Normally, a seamless steel pipe is produced in the following production process. Initially, a heated material (cylindrical round billet) is piercing-rolled by using a piercing mill (piercer), and is further elongation-rolled by an elongator as required to produce a hollow shell. Both the piercer and the elongator include a plug and a plurality of skewed rolls that are disposed around the plug. In addition, as necessary, further elongation rolling is carried out by an elongation rolling mill such as a mandrel mill. To the hollow shell which is produced, sizing rolling is carried out by using a sizing mill (a sizer, a stretch reducer, or the like) as required to give a desired outside diameter and wall thickness to the hollow shell. To the hollow shell that undergoes the above steps, quenching (offline quenching) using a heat treatment furnace is carried out, after which, tempering using a heat treatment furnace is carried out, and strength and a crystal grain size are adjusted. In order to refine crystal grains, quenching may be carried out a plurality of times. By the above process, the seamless steel pipe is produced.

Further, in the above described production process, as for the first quenching, so-called "inline quenching" may be carried out, in which quenching is carried out by directly performing water-cooling on the hollow shell immediately after elongation rolling or sizing rolling, without a heat treatment furnace. Inline quenching is proposed, for example, in Patent Literature 1.

In Patent Literature 1 an ingot is used, which consists of, in mass %, C: 0.15 to 0.20%, Si: 0.01% or more to less than 0.15%, Mn: 0.05 to 1.0%, Cr: 0.05 to 1.5%, Mo: 0.05 to 1.0%, Al: 0.10% or less, V: 0.01 to 0.2%. Ti: 0.002 to 0.03%, B: 0.0003 to 0.005%, N: 0.002 to 0.01%, and the balance being Fe and impurities. The ingot is heated to a temperature of 1000 to 1250° C., and a final rolling temperature is made 900 to 1050° C. to finish pipe-making rolling. Thereafter, the ingot is directly quenched from a temperature of the $Ar_3$ transformation point or more, or after the pipe-making rolling is finished, the ingot is supplementarily heated to the $Ac_3$ transformation point to 1000° C. inline, and is quenched from a temperature of the $Ar_3$ transformation point or more. Thereafter, the ingot is tempered in a temperature range of 600° C. to the $Ac_1$ transformation point. Patent Literature 1 indicates that the seamless steel pipe which is produced by the production method has a strength (758 to 861 MPa) of 110 ksi grade, and has high strength, excellent toughness, and SSC resistance.

CITATION LIST

Patent Literature

Patent Literature 1: Japanese Patent Application Publication No. 2007-31756

Non Patent Literature

Non Patent Literature 1: "Development of Reconstruction Method for Prior Austenite Microstructure Using EBSD Data of Ferrite Microstructure", HATA et al. Technical Report of NIPPON STEEL & SUMITOMO METAL CORPORATION No. 404 (2016), p. 24 to p. 30

SUMMARY OF INVENTION

Technical Problem

As described above, both a piercer and an elongator include a plug, and a plurality of skewed rolls disposed around a pass line. In the present specification, a piercer and an elongator are referred to as a "piercing mill". The piercing mill carries out piercing-rolling (piercer) or elongation rolling (elongator) on a material (a round billet in the piercer, and a hollow shell in the elongator). In the prior production process, a technique is proposed that refines crystal grains by inline quenching or offline quenching using a heat treatment furnace. However, a technique of refining crystal grains in a piercing mill is not proposed.

An object of the present disclosure is to provide a production method of a seamless steel pipe that can suppress coarsening of crystal grains in a piercing mill including a plug, and a plurality of skewed rolls that are disposed around a pass line.

Solution to Problem

A production method of a seamless steel pipe according to the present disclosure includes a heating step of heating an Nb-containing steel material to 800 to 1030° C., the Nb-containing steel material consisting of in mass %,
C: 0.21 to 0.35%,
Si: 0.10 to 0.50%,
Mn: 0.05 to 1.00%,
P: 0.025% or less,
S: 0.010% or less,
Al: 0.005 to 0.100%,
N: 0.010% or less,
Cr: 0.05 to 1.50%, Mo: 0.10 to 1.50%,
Nb: 0.01 to 0.05%,
B: 0.0003 to 0.0050%,
Ti: 0.002 to 0.050%,
V: 0 to 0.30%,
Ca: 0 to 0.0050%,
rare earth metal: 0 to 0.0050%, and
the balance being Fe and impurities;

a pipe-making step of producing a hollow shell by performing piercing-rolling or elongation-rolling on the Nb-containing steel material by using a piercing mill, the piercing mill including a plurality of skewed rolls that are disposed around a pass line on which the Nb-containing steel material passes, a plug that is disposed between the plurality of skewed rolls and on the pass line, and a mandrel bar that extends rearward of the plug along the pass line from a rear end of the plug; and a cooling step immediately after rolling, of carrying out cooling by using a cooling liquid on a hollow shell portion that passes between rear ends of the plurality of skewed rolls, in the hollow shell, so as to reduce an outer surface temperature of the hollow shell portion to 700 to 1000° C. within 15.0 seconds after the hollow shell portion passes between the rear ends of the plurality of skewed rolls.

Advantageous Effects of Invention

A production method of a seamless steel pipe according to the present embodiment can suppress coarsening of crystal grains, in a piercing mill including a plug, and a plurality of skewed rolls disposed around a pass line.

DESCRIPTION OF EMBODIMENTS

The present inventors investigated a method capable of suppressing coarsening of crystal grains of a hollow shell, when piercing-rolling (a piercer) or elongation rolling (an elongator) using a piercing mill (the piercer, or the elongator) is carried out on a steel material.

The present inventors first considered to cause C and Nb to be contained in a steel material, and produce an Nb carbide and an Nb carbo-nitride (hereinafter, referred to as an Nb carbide and the like) during heating before piercing-rolling or elongation rolling, and during piercing-rolling or elongation rolling, so as to suppress coarsening of crystal grains by a pinning effect of the Nb-carbide and the like.

Thus, the present inventors performed rolling with a piercing mill by using an Nb-containing steel material, and investigated the grain sizes (prior-austinite grain sizes) of the crystal grains of the hollow shell after rolling. Specifically, the present inventors performed the following experiment.

An Nb-containing steel material was prepared, which consisted of, in mass %, C: 0.21 to 0.35%, Si: 0.10 to 0.50%. Mn: 0.05 to 1.00%, P: 0.025% or less. S: 0.010% or less, Al: 0.005 to 0.100%, N: 0.010% or less, Cr: 0.05 to 1.50%, Mo: 0.10 to 1.50%, Nb: 0.010 to 0.050%, B: 0.0003 to 0.0050%, Ti: 0.002 to 0.050%, and the balance being Fe and impurities. Piercing-rolling was carried out by using a piercer on the prepared N b-containing steel material, and a hollow shell was produced. A diameter of the produced hollow shell was 430 mm, and a wall thickness was 30 mm.

Figure 1:
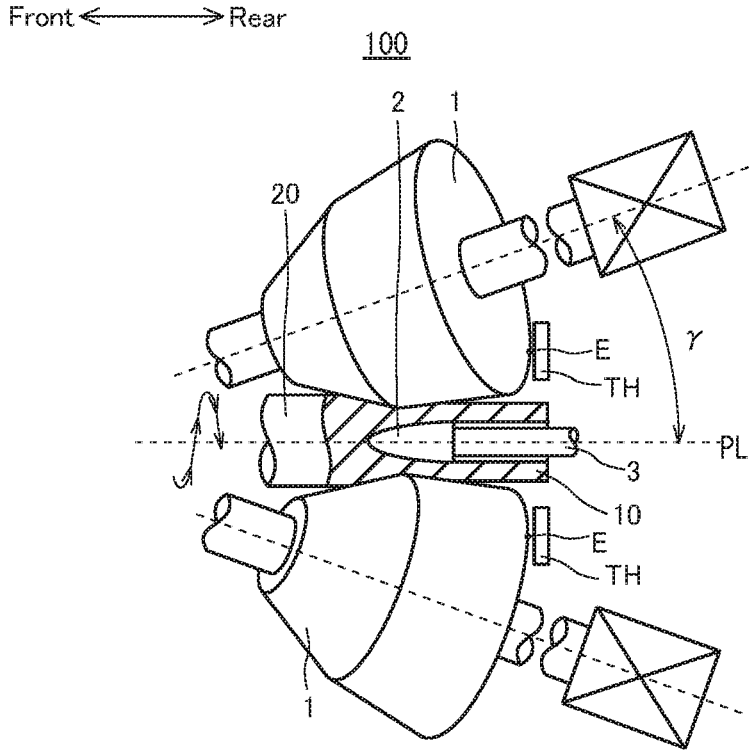
FIG. 1 is a side view of a vicinity of skewed rolls of a piercing mill.

FIG. 1 illustrates a side view of a vicinity of skewed rolls of the piercing mill. FIG. 1 illustrates a sectional view of a part of an Nb-containing steel material 20 during piercing-rolling. The configuration of a piercing mill 100 is common to a piercer or an elongator. In explanation of the present experiment, the piercing mill 100 is described as a piercer, but the explanation is similarly applied to an elongator.

The piercing mill 100 which is a piercer includes a plurality of skewed rolls 1, a plug 2, and a mandrel bar 3. The skewed roll 1 inclines with a predetermined feed angle β (see FIG. 9) with respect to a pass line PL, and crosses the pass line PL at a predetermined toe angle γ. As illustrated in FIG. 1, a thermograph TH was provided in a vicinity of a rear end E of each of the skewed rolls 1 (a position 100 mm behind the piercing mill 100 from the rear end E). The thermograph TH was disposed, and a temperature of a hollow shell portion immediately after piercing-rolling was measured.

Figure 2:
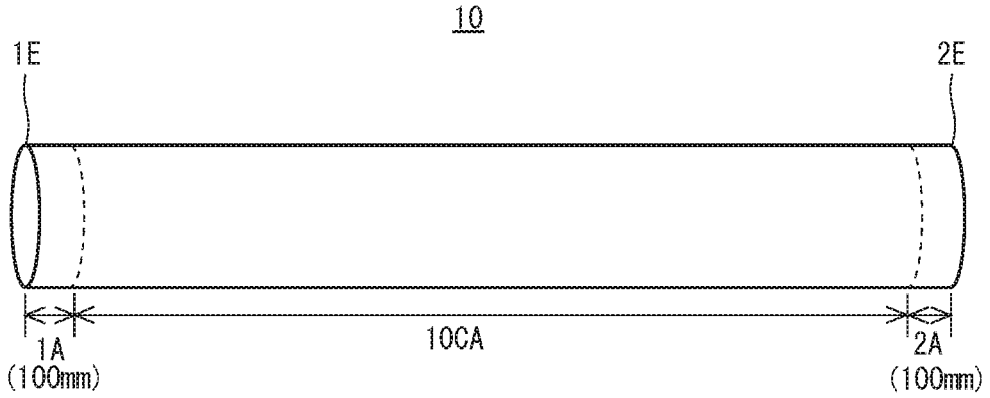
FIG. 2 is a view illustrating an example of a hollow shell produced by piercing-rolling.

FIG. 2 is a view illustrating an example of the hollow shell produced by piercing-rolling. Referring to FIG. 2, a hollow shell 10 includes a first tube end 1E and a second tube end 2E. The second tube end 2E is disposed at an opposite side of (opposite to) the first tube end 1E in an axial direction of the hollow shell 10. In FIG. 2, a range to a position of 100 mm in the axial direction of the hollow shell 10 from the first tube end 1E to the second tube end 2E (to a center in the axial direction of the hollow shell 10) is defined as a first tube end area 1A. Further, a range to a position of 100 mm in the axial direction of the hollow shell 10 from the second tube end 2E to the first tube end 1E (to the center in the axial direction of the hollow shell 10) is defined as a second tube end area 2A. Further, in the hollow shell 10, an area excluding the first tube end area 1A and the second tube end area 2A is defined as a main body area 10CA.

An average value of temperatures that were measured with the above described thermograph TH in respective positions in the axial direction, of the main body area 10CA, in the hollow shell produced by piercing-rolling was defined as an "outer surface maximum temperature" (° C.).

Piercing-rolling was carried out with various piercing ratios with a plurality of heated Nb-containing steel materials, and outer surface maximum temperatures of the respective Nb-containing steel materials were obtained. The piercing ratios were set at 1.2 to 4.0. Further, a roll peripheral speed was set at 1400 to 6000 mm/second. A roll diameter of a gorge portion (maximum diameter portion) of the skewed roll was 1400 mm. The piercing ratio was defined by the following expression.

Piercing ratio=hollow shell length after piercing-rolling/billet length before piercing-rolling In each of the hollow shells after piercing-rolling, a prior-austinite grain size was obtained by a method described later. A relationship of the outer surface maximum temperature and the prior-austinite grain diameter which were obtained was plotted, and FIG. 3 was obtained.

When the hollow shell was produced by performing piercing-rolling on the Nb-containing steel material which was heated at 950° C., the outer surface maximum temperature of the hollow shell became higher than 950° C. This is considered to be due to processing-incurred heat being generated during piercing-rolling.

Figure 3:
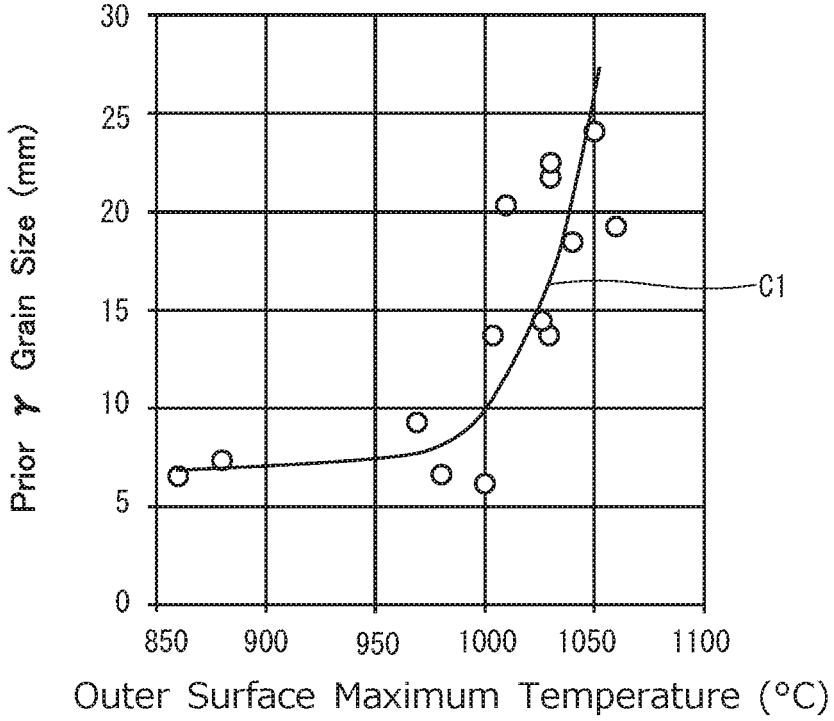
FIG. 3 is a diagram illustrating a relationship between an outer surface maximum temperature of the hollow shell produced by the piercing mill illustrated in FIG. 1 and a prior-austinite grain size.

Referring to FIG. 3, with the Nb-containing steel material having the above described chemical component, the prior-austinite grain size was substantially constant even when the outer surface maximum temperature increased, as long as the outer surface maximum temperature was 1000° C. or less. However, when the outer surface maximum temperature became more than 1000° C., the prior-austinite grain size remarkably increased with increase in the outer surface maximum temperature. In other words, a curved line C1 in FIG. 3 had an inflection point in a vicinity of the outer surface maximum temperature of 1000° C. The present inventors found the fact for the first time by the above described experiment.

Based on the new finding of FIG. 3, the present inventors considered that the following phenomenon occurred when carrying out piercing-rolling using the Nb-containing steel material having the above described chemical composition. If piercing-rolling is carried out with a piercing ratio of 1.2 to 4.0 at a roll peripheral speed of 1400 to 6000 mm/second by using an Nb-containing steel material heated to 950° C., there arises a case where the hollow shell outer surface temperature becomes more than 1000° C. due to processing-incurred heat generated during piercing-rolling.

When a wall thickness of the hollow shell is defined as t (mm), a region where the temperature becomes highest is a position at a depth of t/2 in a radial direction from an outer surface, in the hollow shell immediately after piercing-rolling. Hereinafter, a portion in a position at the depth of t/2 in the radial direction from the outer surface is defined as a "central part of wall thickness".

Figure 4:
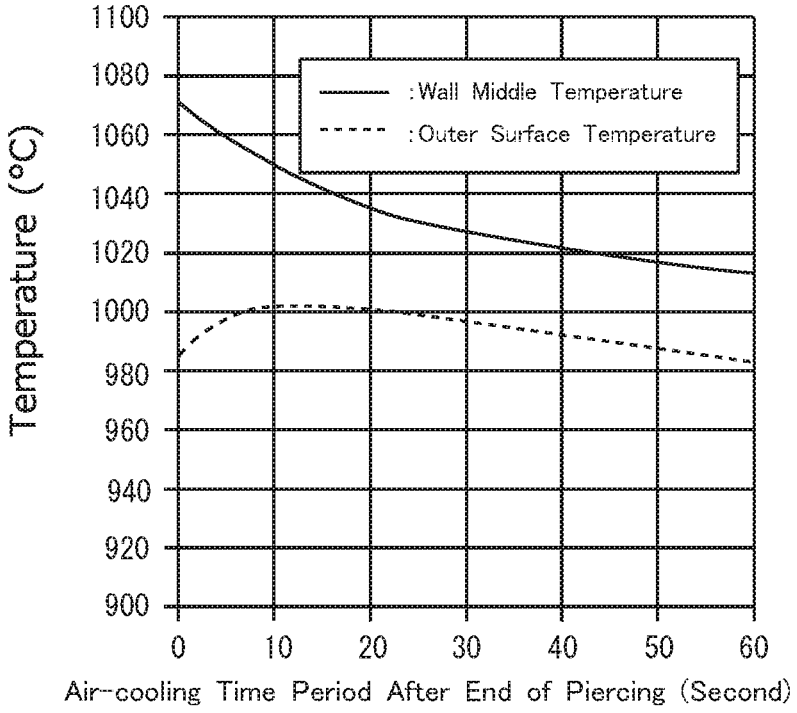
FIG. 4 is a diagram illustrating a hollow shell outer surface temperature and a hollow shell wall middle temperature, with respect to an air-cooling time period immediately after piercing-rolling, in a case where the thick-walled hollow shell of a wall thickness of 50 mm was produced by carrying out piercing-rolling on an Nb-containing steel material.

FIG. 4 is a diagram illustrating a hollow shell outer surface temperature and a hollow shell wall middle temperature, with respect to an air-cooling time period immediately after piercing-rolling in a case where a thick-walled hollow shell of an outside diameter of 420 mm and a wall thickness of 50 mm was produced by carrying out piercing-rolling with a piercing ratio as 1.4 and a roll peripheral speed as 4000 mm/second on a billet outside diameter of 310 mm of the Nb-containing steel material having the aforementioned chemical composition FIG. 4 was obtained by heat transfer calculation using a finite element analysis (FEM analysis). Heat transfer analysis was carried out by using a conventional code DEFORM as analysis software. A temperature distribution of the hollow shell immediately after piercing-rolling was inputted, heat transfer coefficients and radiation rates of inner and outer surfaces of the hollow shell were set, and the temperature distribution was calculated.

Referring to FIG. 4, in 60 seconds after piercing-rolling, the wall middle temperature (solid line in the drawing) is higher than the outer surface temperature (broken line in the drawing), and does not correspond to the outer surface temperature. Further, for 10 seconds immediately after piercing-rolling, a difference between the wall middle temperature and the outer surface temperature decreases with a lapse of time, but after 10 seconds, the difference between the wall middle temperature and the outer surface temperature is 20 to approximately 30° C., and is substantially constant.

As a result of carrying out heat transfer calculation by the aforementioned FEM analysis with various other piercing ratios (2.0 to 4.0) than the piercing ratio in FIG. 4, it was found that at least for 120 seconds after piercing-rolling, a difference between the wall middle temperature and the outer surface temperature was less than 50° C. and was substantially constant, when hollow shells after piercing-rolling were air-cooled.

As described above, in the case of producing a hollow shell by using an Nb-containing steel material, fine Nb carbides and Nb carbo-nitrides (hereinafter, referred to as "Nb carbides and the like") are produced in steel during heating before piercing-rolling, or during piercing-rolling or elongation rolling. Nb carbides and the like suppress coarsening of crystal grains by the pinning effect. Accordingly, if Nb carbides and the like can be used, coarsening of prior-austinite crystal grains of a hollow shell can be suppressed, and can be refined.

However, a fusing point of the Nb carbides and the like is considered to be approximately 1050° C. Based on FIG. 4, there may arise the case where the wall middle temperature becomes more than 1050° C. when the outer surface temperature of a hollow shell after piercing-rolling or elongation rolling becomes more than 1000° C. When the wall middle temperature becomes more than 1050° C. during piercing-rolling or elongation rolling, the Nb carbides and the like which are generated are highly likely to dissolve again. In this case, the pinning effect by the Nb carbides and the like cannot be obtained, and therefore the crystal grains in the hollow shell after piercing-rolling are not sufficiently refined.

In order to suppress dissolution of the N b carbides and the like during piercing-rolling and elongation rolling, the wall middle temperature is restrained from becoming more than 1050° C. Thus, the present inventors examined a method for suppressing processing-incurred heat generated during piercing-rolling.

The present inventors considered that if the piercing ratio is constant, the hollow shell temperature after processing-incurred heat generation also becomes low if the heating temperature for the N b-containing steel material before piercing-rolling is low. Thus, the present inventors produced hollow shells by carrying out piercing-rolling with a same piercing ratio at a same roll peripheral speed on the Nb-containing steel materials of the above described chemical composition, after heating the Nb-containing steel materials of the above described chemical composition with different temperatures. The diameters of the produced hollow shells were 430 mm, and the wall thicknesses were 30 mm. The piercing ratio was 2.0, and the roll peripheral speed was 4000 mm/second. The outer surface maximum temperatures of the hollow shells immediately after piercing-rolling were measured by the above described method. Based on the heat transfer calculation result obtained in FIG. 4, the wall middle temperature was calculated from the obtained outer surface maximum temperature.

Figure 5:
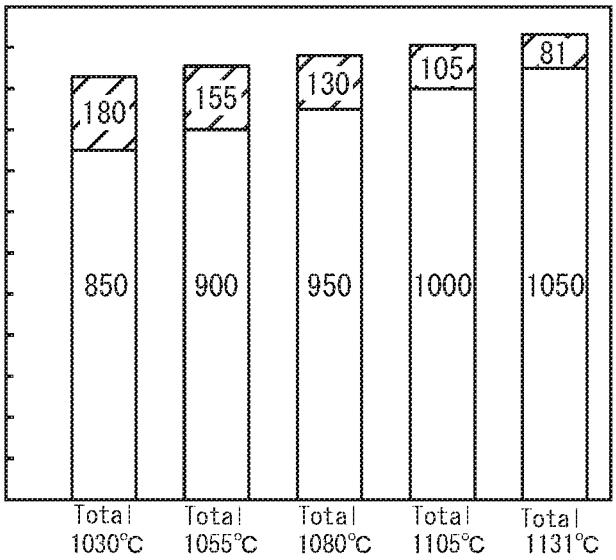
FIG. 5 is a graph illustrating a heating temperature of the Nb-containing material before piercing-rolling, and a processing-incurred heat temperature increase amount.

The calculation result is illustrated in FIG. 5. A numeric value in a white area in each of column graphs in FIG. 5 means a heating temperature (° C.). A numeric value in a hatched area means a processing-incurred heat amount (° C.). A total of the white area and the hatched area in FIG. 5 means a wall middle temperature (° C.) of the hollow shell immediately after piercing-rolling. Referring to FIG. 5, it was found that even when the heating temperature is varied in a range of 850 to 1050° C., the wall middle temperature immediately after piercing-rolling did not change so much. For example, the wall middle temperature immediately after piercing-rolling in the case of the heating temperature of 850° C. was 1030° C. and the wall middle temperature immediately after piercing-rolling in the case of the heating temperature of 950° C. was 1080° C. When both the cases are compared, the difference of the wall middle temperatures immediately after piercing-rolling stays 50° C. (1080° C.-1030°) although the heating temperature difference is 100° C. (950° C.-850° C.). As illustrated in FIG. 5, the processing-incurred heat amount was larger as the heating temperature was lower. As the heating temperature is lower, a deformation resistance of the Nb-containing steel material becomes higher.

Therefore, even with the same piercing ratio, the processing-incurred heat amount is considered to be larger as the heating temperature is lower.

Based on the above finding, the present inventors considered it difficult to refine crystal grains by simply reducing the heating temperature. Thus, the present inventors performed further examination.

The processing-incurred heat is generated even when the heating temperature is reduced, and as the heating temperature is reduced to a lower temperature, the processing-incurred heat amount becomes larger. Thus, the present inventors changed their minds, and examined a method for not dissolving Nb carbides and the like once processing-incurred heat is generated, instead of suppressing generation of processing-incurred heat.

As described above, the fusing point of the Nb carbides and the like is approximately 1050° C. However, the present inventors have considered that the Nb carbides and the like do not dissolve at the same time when a steel material temperature increases to 1050° C., but dissolve when the steel material temperature is kept at 1050° C. or more for some time.

Thus, a processing Formastor test using a ThermecMastor testing machine (hot working reproduction testing machine) was carried out. Specifically, a plurality of Nb-containing steel test specimens (outside diameter of 8 mm×length of 12 mm) of the above described chemical composition were prepared. The prepared test specimens were heated to 950° C. A compression test was carried out in the atmosphere with respect to the heated test specimens. A compression rate was set at 75% (corresponding to a piercing rate of 2.1), and a strain rate was set at 1.4/second. After the compression test, the test specimens were heated to a predetermined simulated heat generation temperature simulated heat generation temperature (1000 to 1200° C.). Subsequently, the test specimens were held at the predetermined simulated heat generation temperature for a predetermined time period (15.0 seconds, 25.0 seconds, or 45.0 seconds). The test specimens after being held were rapidly cooled by being submerged in a water tank. In arbitrary sections of the test specimens after rapid cooling, prior-austinite grain sizes were obtained by a method described later, and FIG. 6 was created.

Figure 6:
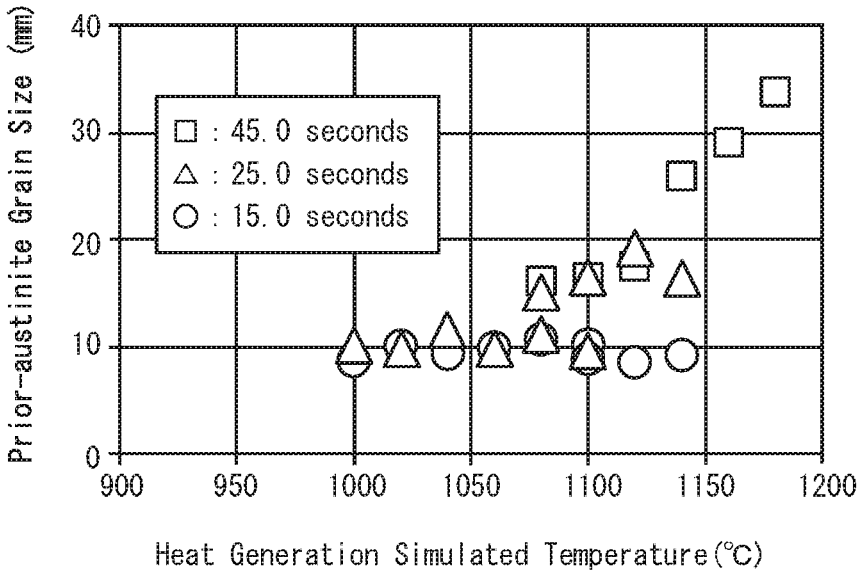
FIG. 6 is a diagram illustrating a relationship between a simulated heat generation temperature simulated heat generation temperature and a prior-austinite grain size which is obtained by a processing Formastor test.

Referring to FIG. 6, in the case of the simulated heat generation temperature (corresponding to the wall middle temperature) being 1050° C. or less, the prior-austinite grain sizes were as small as approximately 10 μm, even when the holding time period was 45.0 seconds. When the simulated heat generation temperature became more than 1050° C., a change was found in the prior-austinite grain size in accordance with the holding time period. Specifically, when the simulated heat generation temperature became more than 1050° C., the prior-austinite grains are coarsened remarkably when the holding time periods were 25.0 seconds and 45.0 seconds, and the grain size remarkably increased to be more than 10 μm. When the holding time period is 15.0 seconds, the prior-austinite grain size kept approximately 10 μm even when the simulated heat generation temperature became more than 1050° C. The present inventors found the fact for the first time by the above described experiment.

From the above new finding, the present inventors thought of the following matter. Even when processing-incurred heat is generated in the Nb-containing steel material, and the wall middle temperature of the Nb-containing steel material (hollow shell) becomes more than 1050° C. during piercing-rolling, the Nb carbides and the like do not completely dissolve, and the effective amount of Nb carbides and the like to the pinning effect remains if the temperature of the Nb-containing steel material is reduced to 1050° C. or less within at least 15.0 seconds after the wall middle temperature becomes more than 1050° C. As a result, coarsening of crystal grains of the hollow shell after piercing-rolling or elongation rolling is suppressed.

As above, the present inventors newly found that the crystal grains are refined if the wall middle temperature is reduced to 1050° C. or less within 15.0 seconds, once processing-incurred heat is generated, and the wall middle temperature becomes more than 1050° C., instead of suppressing processing-incurred heat by simply reducing the temperature of the Nb-containing steel material during heating before piercing-rolling.

Thus, in order to realize the above described method, the present inventors thought of the following method. A cooling mechanism by a cooling liquid is provided on a skewed roll outlet side of the piercing mill. By the cooling mechanism, cooling is carried out on the hollow shell immediately after piercing-rolling or immediately after elongation rolling, and within 15.0 seconds after a hollow shell portion passes through rearmost ends of the skewed rolls in a front-rear direction of the piercing mill, the outer surface temperature of the hollow shell portion is reduced to 1000° C. or less. In this case, the wall middle temperature of the hollow shell portion reduces to 1050° C. or less within 15.0 seconds after the hollow shell portion passes through the rearmost ends of the skewed rolls in the front-rear direction of the piercing mill. Consequently, dissolution of the Nb carbides and the like is suppressed, and the effective amount of Nb carbides and the like to the pinning effect remains. As a result, crystal grains are maintained to be fine in the hollow shell after piercing-rolling or after elongation rolling.

While in the above described explanation, piercing-rolling is shown as an example by using a piercer, it has been found that a similar effect is obtained in elongation rolling by an elongator including a plurality of skewed rolls, and a plug disposed between the plurality of skewed rolls, as a result of further examination by the present inventors.

As above, the present invention realizes refinement of crystal grains by cooling the outer surface temperature of the hollow shell to 1000° C. or less by before the Nb carbides and the like effective to the pinning effect are excessively dissolved once processing-incurred heat is generated, and is totally different from the conventional technical idea.

A production method of a seamless steel pipe according to a configuration of (1) completed by the above described technical idea includes a heating step of heating an Nb-containing steel material to 800 to 1030° C., the Nb-containing steel material consisting of in mass %, C: 0.21 to 0.35%, Si: 0.10 to 0.50%, Mn: 0.05 to 1.00%, P: 0.025% or less, S: 0.010% or less, Al: 0.005 to 0.100%, N: 0.010% or less, Cr: 0.05 to 1.50%, Mo: 0.10 to 1.50%, Nb: 0.01 to 0.05%, B: 0.0003 to 0.0050%, Ti: 0.002 to 0.050%, V: 0 to 0.30%, Ca: 0 to 0.0050%, rare earth metal: 0 to 0.0050%, and the balance being Fe and impurities;

a pipe-making step of producing a hollow shell by piercing-rolling or elongation rolling the Nb-containing steel material, by using a piercing mill, the piercing mill including, a plurality of skewed rolls that are disposed around a pass line on which the Nb-containing steel material passes, a plug that is disposed between the plurality of skewed rolls and on the pass line, and a mandrel bar that extends rearward of the plug along the pass line from a rear end of the plug; and a cooling step immediately after rolling, of carrying out cooling by using a cooling liquid on a hollow shell portion that passes between rear ends of the plurality of skewed rolls, in the hollow shell, so as to reduce an outer surface temperature of the hollow shell portion to 700 to 1000° C. within 15.0 seconds after the hollow shell portion passes between the rear ends of the plurality of skewed rolls.

A production method of a seamless steel pipe according to a configuration of (2) is the production method of a seamless steel pipe described in (1), and in the cooling step immediately after rolling, the outer surface temperature of the hollow shell portion is reduced to 700 to 1000° C. within 15.0 seconds after the hollow shell portion passes between the rear ends of the plurality of skewed rolls, by ejecting the cooling liquid toward an outer surface and/or an inner surface of the hollow shell portion that passes between the rear ends of the plurality of skewed rolls.

A production method of a seamless steel pipe according to a configuration of (3) is the production method of a seamless steel pipe described in (2), wherein the piercing mill includes an outer surface cooling mechanism that is disposed around the mandrel bar behind the plurality of skewed rolls, and includes a plurality of outer surface cooling liquid ejection holes capable of ejecting the cooling liquid toward an outer surface of the hollow shell during piercing-rolling or elongation rolling, and in the cooling step immediately after rolling, the outer surface of the hollow shell portion that passes between the rear ends of the plurality of skewed rolls is cooled by ejecting the cooling liquid from the outer surface cooling mechanism to reduce the outer surface temperature of the hollow shell portion to 700 to 1000° C. within 15.0 seconds after the hollow shell portion passes between the rear ends of the plurality of skewed rolls.

A production method of a seamless steel pipe according to a configuration of (4) is the production method of a seamless steel pipe described in (3), wherein the outer surface cooling mechanism cools the outer surface of the hollow shell portion that passes in a cooling zone having a specific length in an axial direction of the mandrel bar, the piercing mill further includes a front outer surface damming mechanism that is disposed around the mandrel bar behind the plug and in front of the outer surface cooling mechanism, and in the cooling step immediately after rolling, the cooling liquid is restrained from flowing to an outer surface portion of the hollow shell that is before entering the cooling zone by the front outer surface damming mechanism, when the hollow shell is being cooled by the outer surface cooling mechanism.

The production method of a seamless steel pipe according to a configuration of (5) is the production method of a seamless steel pipe according to (4), wherein the front outer surface damming mechanism includes a plurality of front damming fluid ejection holes that are disposed around the mandrel bar, and eject front damming fluid toward the outer surface of the hollow shell, and in the cooling step immediately after rolling, the cooling liquid is dammed from flowing to the outer surface portion of the hollow shell that is before entering the cooling zone by ejecting the front damming fluid toward an upper portion of the outer surface of the hollow shell that is located in a vicinity of an entrance side of the cooling zone, from the front outer surface damming mechanism, when the hollow shell is being cooled by the outer surface cooling mechanism.

A production method of a seamless steel pipe according to a configuration of (6) is the production method of a seamless steel pipe according to any one of (3) to (5), wherein the outer surface cooling mechanism cools the outer surface of the hollow shell portion that passes in a cooling zone having a specific length in an axial direction of the mandrel bar, the piercing mill further includes a rear outer surface damming mechanism that is disposed around the mandrel bar behind the plug and behind the outer surface cooling mechanism, and in the cooling step immediately after rolling, the rear outer surface damming mechanism restrains the cooling liquid from contacting an outer surface portion of the hollow shell that is located behind the cooling zone, when the outer surface cooling mechanism is cooling the hollow shell.

A production method of a seamless steel pipe according to a configuration of (7) is the production method of a seamless steel pipe according to (6), wherein the rear outer surface damming mechanism includes a plurality of rear damming fluid ejection holes that are disposed around the mandrel bar, and eject rear damming fluid toward the outer surface of the hollow shell, and in the cooling step immediately after rolling, the rear outer surface damming mechanism dams the cooling liquid from flowing to an upper portion of the outer surface of the hollow shell that is after exiting the cooling zone, by ejecting the rear damming fluid toward the upper portion of the outer surface of the hollow shell that is located in a vicinity of a outlet side of the cooling zone, when the outer surface cooling mechanism is cooling the hollow shell.

A production method of a seamless steel pipe according to a configuration of (8) is the production method of a seamless steel pipe according to (2), wherein the mandrel bar includes a bar main body, a cooling liquid flow path that is formed in the bar main body, and allows the cooling liquid to pass inside, and an inner surface cooling mechanism that is disposed in the cooling zone that has a specific length in an axial direction of the mandrel bar, and is located in a fore end portion of the mandrel bar, in the bar main body, and cools an inner surface of the hollow shell advancing in the cooling zone by ejecting the cooling liquid that is supplied from the cooling liquid flow path toward an outer portion of the bar main body during piercing-rolling or elongation rolling, and in the cooling step immediately after rolling, the inner surface of the hollow shell portion that passes between the rear ends of the plurality of skewed rolls is cooled by ejecting the cooling liquid from the inner surface cooling mechanism to reduce the outer surface temperature of the hollow shell portion to 700 to 1000° C. within 15.0 seconds after the hollow shell portion passes between the rear ends of the plurality of skewed rolls.

A production method of a seamless steel pipe according to a configuration of (9) is the production method of a seamless steel pipe according to (3), wherein the mandrel bar includes a bar main body, a cooling liquid flow path that is formed in the bar main body, and allows the cooling liquid to pass inside, and an inner surface cooling mechanism that is disposed in the cooling zone that has a specific length in an axial direction of the mandrel bar, and is located in a fore end portion of the mandrel bar, in the bar main body, and cools an inner surface of the hollow shell advancing in the cooling zone by ejecting the cooling liquid that is supplied from the cooling liquid flow path toward an outer portion of the bar main body during piercing-rolling or elongation rolling, and in the cooling step immediately after rolling, the outer surface and the inner surface of the hollow shell portion that passes between the rear ends of the plurality of skewed rolls are cooled by ejecting the cooling liquid from the outer surface cooling mechanism, and ejecting the cooling liquid from the inner surface cooling mechanism to reduce the outer surface temperature of the hollow shell portion to 700 to 1000° C. within 15.0 seconds after the hollow shell portion passes between the rear ends of the plurality of skewed rolls.

A production method of a seamless steel pipe according to a configuration of (10) is the production method of a seamless steel pipe according to (8) or (9), wherein the mandrel bar further includes an inner surface damming mechanism that is disposed behind the cooling zone adjacently to the cooling zone, and restrains the cooling liquid that is ejected to an outer portion of the bar main body from contacting the inner surface of the hollow shell that is after exiting the cooling zone, during piercing-rolling or elongation rolling, and in the cooling step immediately after rolling, the inner surface of the hollow shell portion in the cooling zone is cooled by ejecting the cooling liquid from the inner surface cooling mechanism, and the cooling liquid is restrained from contacting the inner surface of the hollow shell that is after exiting the cooling zone by the inner surface damming mechanism.

A production method of a seamless steel pipe according to a configuration of (11) is the production method of a seamless steel pipe according to (10), wherein the mandrel bar further includes a compression gas flow path that is formed in the bar main body, and allows compression gas to pass through, the inner surface damming mechanism includes a plurality of compression gas ejection holes that are arranged in a circumferential direction, or in the circumferential direction and an axial direction of the bar main body, and eject the compression gas that is supplied from the compression gas flow path, in a contact suppression zone that is disposed behind the cooling zone adjacently to the cooling zone, and in the cooling step immediately after rolling, the cooling liquid is restrained from flowing to the inner surface of the hollow shell portion that exits the cooling zone and enters the contact suppression zone, by ejecting the compression gas from the inner surface damming mechanism.

The above described mandrel bar may further include a gas flow path that is formed in the bar main body, and allows the compression gas to flow through. In this case, the damming mechanism includes a plurality of inner surface compression gas ejection holes that connect to the gas flow path, and are capable of ejecting the compression gas toward the inner surface of the hollow shell portion from the bar main body during piercing-rolling or elongation rolling. In the cooling step immediately after rolling, the damming mechanism restrains the inner surface of the hollow shell portion that passes through the damming zone disposed behind the cooling zone from being cooled by the cooling liquid, by ejecting the compression gas.

In the above described cooling step immediately after rolling, a heat transfer coefficient during cooling by the cooling liquid may be made 1000 $W/m^2 \cdot K$.

A production method of a seamless steel pipe according to a configuration of (12) is the production method of a seamless steel pipe according to any one of (1) to (11), wherein the piercing mill is a piercer, in the pipe-making step, the hollow shell is produced by performing piercing-rolling on the Nb-containing steel material by using the piercer, and in the cooling step immediately after rolling, the outer surface temperature of the hollow shell portion is reduced to 800 to 1000° C. within 15.0 seconds after the hollow shell portion passes between the rear ends of the plurality of skewed rolls, by carrying out cooling by using the cooling liquid on the hollow shell portion that passes between the rear ends of the plurality of skewed rolls, in the hollow shell.

A production method of a seamless steel pipe according to a configuration of (13) is the production method of a seamless steel pipe according to any one of (1) to (11), wherein the piercing mill is an elongator, in the pipe-making step, a hollow shell that is the Nb-containing steel material is elongation-rolled by using the elongator, and in the cooling step immediately after rolling, the outer surface temperature of the hollow shell portion is reduced to 700 to 1000° C. within 15.0 seconds after the hollow shell portion passes between the rear ends of the plurality of skewed rolls by carrying out cooling by using the cooling liquid on the hollow shell portion that passes between the rear ends of the plurality of skewed rolls, in the hollow shell.

A production method of a seamless steel pipe according to a configuration of (14) is a production method of a seamless steel pipe according to any one of (1) to (13), further including a quenching step of carrying out quenching at a temperature of an A transformation point or more on the hollow shell after the cooling step immediately after rolling; and a temper step of carrying out temper at a temperature of an Ai transformation point or less on the hollow shell after the quenching step.

Hereinafter, the production method of a seamless steel pipe according to an embodiment of the present invention will be described. Same or corresponding portions in the drawings are assigned with same reference signs, and explanation thereof is not repeated.

[Configuration of Hollow Shell]

FIG. 2 is a view illustrating an example of a hollow shell that is made of an Nb-containing steel material by using a piercing mill (a piercer, or an elongator) in the present embodiment. Referring to FIG. 2, the hollow shell 10 includes the first tube end 1 and the second tube end 2E. The second tube end 2E is disposed at an opposite side of (opposite to) the first tube end 1E, in the axial direction of the hollow shell 10. In FIG. 2, a range from the first tube end 1E to a position 100 mm in the axial direction of the hollow shell 10 to the second tube end 2E is defined as a first tube end area 1A. Further, a range from the second tube end 2E to the position 100 mm in the axial direction of the hollow shell 10 to the first tube end 1E is defined as a second tube end area 2A. Further, in the hollow shell 10, an area excluding the first tube end area 1A and the second tube end area 2A is defined as a main body area 10CA.

[Nb-Containing Steel Material]

The hollow shell that is produced in a pipe-making process of the present embodiment is made of the Nb-containing steel material. The Nb-containing steel material may be a cylindrical round billet or may be a hollow shell. When the piercing mill is a piercer, the Nb-containing steel material is around billet. When the piercing mill is an elongator, the Nb-containing steel material is a hollow shell.

A chemical composition of the Nb-containing steel material contains elements as follows, for example.

C: 0.21 to 0.35%

Carbon (C) increases strength of steel. When a C content is too low, the effect is not obtained. When the C content is too high on the other hand, susceptibility to quench cracking of the steel increases. When the C content is too high, toughness of the steel may be reduced. Accordingly, the C content is 0.21 to 0.35%. A lower limit of the C content is 0.23%, and a more preferable lower limit is 0.25%. An upper limit of the C content is preferably 0.30%, and is more preferably 0.27%.

Si: 0.10 to 0.50%

Silicon (Si) deoxidates steel. When the Si content is too low, the effect is not obtained. When the Si content is too high on the other hand, SSC resistance and workability of steel are reduced. Accordingly, the Si content is 0.10 to 0.50%. A lower limit of the Si content is preferably 0.15%, and is more preferably 0.20%. An upper limit of the Si content is preferably 0.40%, and is more preferably 0.35%.

Mn: 0.05 to 1.00%

Manganese (Mn) increases hardenability of steel, and increases strength of steel. When an Mn content is too low, the effect is not obtained. When the Mn content is too high on the other hand, Mn segregates in grain boundaries, and SSC resistance of the steel is reduced. Accordingly, the Mn content is 0.05 to 1.00%. A lower limit of the Mn content is preferably 0.30%, and is more preferably 0.40%. An upper limit of the Mn content is preferably 0.95%, and is more preferably 0.90%.

P: 0.025% or Less

Phosphorus (P) is an impurity, and is inevitably contained in steel. In other words, a P content is more than 0%. P segregates in grain boundaries and reduces SSC resistance of the steel. Accordingly, the P content is 0.025% or less. An upper limit of the P content is preferably 0.020%, and is more preferably 0.015%. The P content is preferably as low as possible. However, excessive dephosphorization treatment increases production cost. Accordingly, in consideration of an ordinary operation, a lower limit of the P content is preferably 0.001%, and is more preferably 0.002%.

S: 0.010% or Less

Sulfur (S) is an impurity, and is inevitably contained in steel. In other words, an S content is more than 0%. S combines with Mn to form sulfide inclusions, and reduces SSC resistance of steel. Accordingly, the S content is 0.010% or less. An upper limit of the S content is preferably 0.006%, and is more preferably 0.003%. The S content is preferably as low as possible. However, excessive desulfurization increases production cost. Accordingly, in consideration of an ordinary operation, a lower limit of the S content is preferably 0.001%, and is more preferably 0.002%.

Al: 0.005 to 0.100%

Aluminum (Al) deoxidates steel. When an AL content is too low, the effect is not obtained. When the Al content is too high, the effect is saturated. When the AL content is too high, a large amount of coarse Al oxides is produced to reduce SSC resistance of the steel. Accordingly, the AL content is 0.005 to 0.100%. A lower limit of the Al content is preferably 0.010%, and is more preferably 0.020%. An upper limit of the Al content is preferably 0.070%, and is more preferably 0.050%. In the present specification, the Al content means a content of so-called acid-soluble Al (sol. Al).

N: 0.010% or Less

Nitrogen (N) is inevitably contained in steel. In other words, an N content is more than 0%. N forms nitrides. Fine nitrides prevent coarsening of crystal grains, and therefore N may be contained. On the other hand, coarse nitrides reduce SSC resistance of steel. Accordingly, the N content is 0.010% or less. An upper limit of the N content is preferably 0.004%, and is more preferably 0.003%. A lower limit of the N content for obtaining the pinning effect by precipitation of fine nitrides is preferably 0.002%. Excessive denitrification treatment increases production cost. Accordingly, when an ordinary operation is taken into consideration, the lower limit of the N content is preferably 0.001%, and is more preferably 0.002%.

Cr: 0.05 to 1.50%

Chrome (Cr) increases hardenability of steel, and increases strength of the steel. When a Cr content is too low, the effects are not obtained. When the Cr content is too high on the other hand, SSC resistance of the steel is reduced. Accordingly, the Cr content is 0.05 to 1.50%. A lower limit of the Cr content is preferably 0.20%, and is more preferably 0.40%. An upper limit of the Cr content is preferably 1.20%, and is more preferably 1.15%.

Mo: 0.10 to 1.50%

Molybdenum (Mo) increases hardenability of steel, and increases strength of the steel. Mo further increases temper softening resistance of steel, and increases SSC resistance by high-temperature temper. When the Mo content is too low, the effects are not obtained. When the Mo content is too high, the effects are saturated, and production cost increases. Accordingly, the Mo content is 0.10 to 1.50%. A lower limit of the Mo content is preferably 0.15%, and is more preferably 0.20%. An upper limit of the Mo content is preferably 0.80%, and is more preferably 0.60%.

Nb: 0.01 to 0.05%

Niobium (Nb) combines with C and N to form fine Nb carbides and Nb carbon-nitrides (Nb carbides and the like) during heating, piercing-rolling time or elongation rolling. Nb carbides and the like refine crystal grains by the pinning effect to increase SSC resistance of the steel. These carbon nitrides and the like further suppress variation in crystal grain size. When the Nb content is too low, the effects are not obtained. When the Nb content is too high on the other hand, a large amount of coarse N b inclusions are produced, and SSC resistance of steel is reduced. Accordingly, the Nb content is 0.01 to 0.05%. A lower limit of the Nb content is preferably 0.02%. An upper limit of the Nb content is preferably 0.04%, and is more preferably 0.03%.

B: 0.0003 to 0.0050%

Boron (B) increases hardenability of steel, and increases strength of the steel. When a B content is too low, the effects are not obtained. When the B content is too high on the other hand, carbon nitrides precipitate at grain boundaries, and SSC resistance of steel is reduced. Accordingly, the B content is 0.0003 to 0.0050%. A lower limit of the B content is preferably 0.0005%, and is more preferably 0.0008%. An upper limit of the B content is preferably 0.0030%, and is more preferably 0.0020%.

Ti: 0.002 to 0.050%

Titanium (Ti) combines with C and N to form fine Ti carbon-nitride, and immobilizes N that is an impurity. By production of Ti nitrides, crystal grains are refined, and strength of steel is further increased. When B is contained in steel, Ti further suppresses production of B nitrides, and therefore, increase in hardenability by B is promoted. When a Ti content is too low, the effects are not obtained. When the Ti content is too high on the other hand, Ti dissolves in Nb inclusions, and the Nb inclusions are coarsened. In this case, SSC resistance of steel is reduced. Accordingly, the Ti content is 0.002 to 0.050%. A lower limit of the Ti content is preferably 0.003%, and is more preferably 0.004%. An upper limit of the Ti content is preferably 0.035%, and is more preferably 0.030%.

The balance of the chemical composition of the Nb-containing steel material of the present embodiment is Fe and impurities. Here, the impurities mean matters that are mixed from ore and scrap as a raw material, a production environment and the like when the Nb-containing steel material is industrially produced, and are allowed within a range without having an adverse effect on the Nb-containing steel material. Of the impurities, an oxygen (O) content is 0.005% or less.

[Optional Element]

The chemical composition of the aforementioned Nb-containing steel material may further contain V in place of part of Fe.

V: 0 to 0.30%

Vanadium (V) is an optional element, and may not be contained. In other words, a V content may be 0%. When V is contained, V produces fine carbides to increase temper softening resistance, and enables high-temperature temper. Thereby, SSC resistance of steel is increased. However, when the V content is too high, carbides are excessively produced, and SSC resistance of steel is rather reduced.

Accordingly, the V content is 0 to 0.30%. A lower limit of the V content for obtaining the above described effect more effectively is preferably 0.01%, and is more preferably 0.02%. An upper limit of the V content is preferably 0.25%, and is more preferably 0.20%.

The chemical composition of the aforementioned Nb-containing steel material may further contain one kind or more selected from the group consisting of Ca and rare earth metals in place of part of Fe.

Ca: 0 to 0.0050%

Calcium (Ca) is an optional element, and may not be contained. In other words, Ca may be 0%. When Ca is contained, Ca spheroidizes sulfide inclusions in steel. Thereby, SSC resistance of steel is increased. If Ca is contained even a little, the above described effect is obtained. However, when the Ca content is too high, an extremely large amount of inclusions is produced, and SSC resistance of steel is reduced. Accordingly, the Ca content is 0 to 0.0050%. A lower limit of the Ca content is preferably 0.0001%, is more preferably 0.0010%, and far more preferably 0.0015%. An upper limit of the Ca content is preferably 0.0040%, and is more preferably 0.0030%.

Rare Earth Metal (REM): 0 to 0.0050%

A rare earth metal (REM) is an optional element, and may not be contained. In other words, REM may be 0%. When REM is contained, REM spheroidizes sulfide inclusions in steel. Thereby, SSC resistance of steel is increased. If REM is contained even a little, the above describe effect is obtained. However, when the REM content is too high, an excessively large amount of inclusions is produced, and SSC resistance of steel is reduced. Accordingly, the REM content is 0 to 0.0050%. A lower limit of the REM content is preferably 0.0001%, and is more preferably 0.0010%. An upper limit of the REM content is preferably 0.0040%, and is more preferably 0.0030%.

The REM in the present specification contains at least one kind or more of Sc, Y, and lanthanoids (La of atomic number 57 to Lu of atomic number 71), and the REM content means a total content of these elements.

[Production Layout of Seamless Steel Pipe]

An equipment system line for seamless steel pipe includes, for example, patterns in FIG. 7A to FIG. 7C as follows.

Figure 7A:
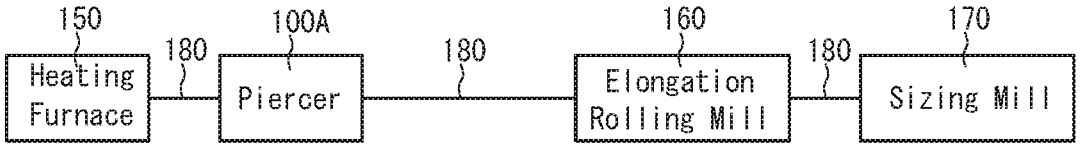
FIG. 7A is a schematic diagram illustrating an example of an equipment system line of a seamless steel pipe.

In FIG. 7A, a heating furnace 150, a piercer 10A, an elongation rolling mill 160, and a sizing mill 170 are arranged in line in order from upstream to downstream of the equipment system line. Among the facilities, transfer paths 180 are disposed. The transfer paths 180 are mechanisms that transfer the Nb-containing steel material or a hollow shell that passes through the respective facilities, and are, for example, transfer rollers.

The elongation rolling mill 160 is a rolling mill that elongation-rolls the hollow shell, and is, for example, a mandrel mill. The sizing mill 170 is a rolling mill for adjusting an outside diameter of the hollow shell to a predetermined size, and is, for example, a sizer, a stretch reducer or the like. In FIG. 7B, the heating furnace 150, the piercer 100A, an elongator 100B, a plug mill 100C, and the sizing mill 170 are arranged in the order from upstream to downstream of the equipment system line. In FIG. 7C, the heating furnace 150, the piercer 100A, the plug mill 100C, and the size adjusting rolling machine 170 are arranged in order from upstream to downstream of the equipment system line.

Figure 7B:
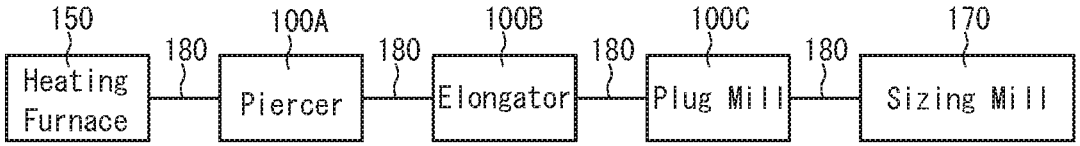
FIG. 7B is a schematic diagram illustrating an example of another equipment system line of a seamless steel pipe, which is different from FIG. 7A.
Figure 7C:
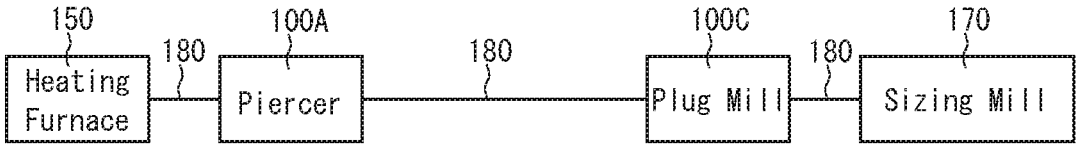
FIG. 7C is a schematic diagram illustrating an example of another equipment system line of a seamless steel pipe, which is different from FIG. 7A and FIG. 7B.

The equipment system line is not limited to FIG. 7A to FIG. 7C. The equipment system line that is used in the production method of a seamless steel pipe of the present embodiment can include at least the heating furnace 150 and the piercing mill 100 (the piercer 100A and/or the elongator 100B).

Further, a water-cooling device for inline quenching (direct quenching) may be disposed downstream of the piercing mill 100, or a supplementary heating furnace for reheating a hollow shell may be included among the respective facilities. The supplementary heating furnace is, for example, an induction heater or the like.

[Production Method of Seamless Steel Pipe]

The production method of a seamless steel pipe using the Nb-containing steel material having the aforementioned chemical composition includes a heating step, a pipe-making step, and a cooling step immediately after rolling. Hereinafter, the respective steps will be described. In the present embodiment, a case where the cooling step immediately after rolling completion is carried out after piercing-rolling by the piercer 100A will be described. However, the cooling step immediately after rolling may be carried out in the elongator 100B. The cooling step immediately after rolling may be carried out in both the piercer 10A and the elongator 100B.

[Heating Step]

In the heating step, the Nb-containing steel material that is a cylindrical billet (round billet) is heated. In the heating step, the Nb-containing steel material is heated by using the well-known heating furnace 150, for example. The heating furnace 150 may be a rotary hearth furnace, or a walking beam furnace.

The production method of the Nb-containing steel material is not specially limited, but the Nb-containing steel material is produced by the following method, for example. A molten steel having the above describe chemical composition is produced. For example, a converter or the like is used in production of the molten steel. Bloom by the continuous casting process is produced by using the molten steel. Ingot may be produced by an ingot making method by using the molten steel. By hot-rolling the bloom and ingot, a round billet with a circular cross section is produced. A round billet may be produced by a continuous casting process by using the molten steel. Around billet is prepared by the above method.

The prepared Nb-containing steel material (round billet) is heated. A heating temperature is set at 800 to 1030° C. The heating temperature mentioned here means an in-furnace temperature of the heating furnace. When the in-furnace temperature is 800 to 1030° C., the outer surface temperature of the Nb-containing steel material is also 800 to 1030° C.

When the heating temperature for the Nb-containing steel material (the outer surface temperature of the Nb-containing steel material) in the heating step is 1030° C. or less, the crystal grains of the hollow shell can be restrained from being coarsened, and can be refined, on the precondition that conditions of the pipe-making step and the cooling step immediately after rolling which are described later are satisfied. Therefore, an upper limit of the heating temperature for the Nb-containing steel material in the heating step is 1030° C. When the heating temperature for the Nb-containing steel material in the heating step is too low on the other hand, deformation resistance of the Nb-containing steel material increases. In this case, piercing-rolling becomes difficult. Accordingly, a lower limit of the heating temperature of the Nb-containing steel material in the heating step is 800° C. An upper limit of the heating temperature in the heating step is preferably 1020° C., is more preferably 1010° C., and is much more preferably 1000° C. The lower limit of the heating temperature in the heating step is preferably 850° C., is more preferably 870° C., and is much more preferably 900° C.

[Configuration of Piercing Mill 100]

After the heating step, the pipe-making step and the cooling step immediately after rolling are carried out. Before describing the pipe-making step and the cooling step immediately after rolling, a configuration of the piercing mill 100 that is used in these steps will be described.

Figure 8:
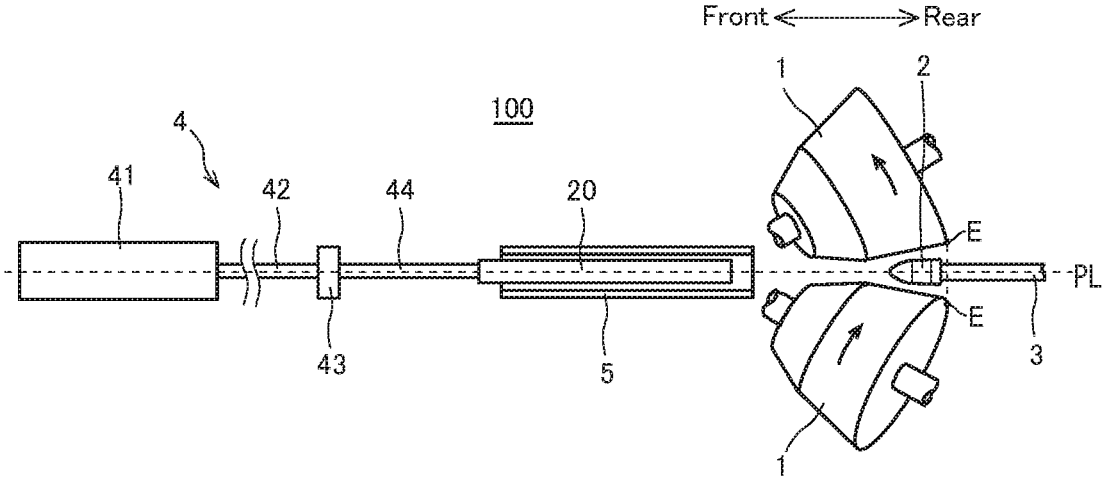
FIG. 8 is a side view of a piercing mill.
Figure 9:
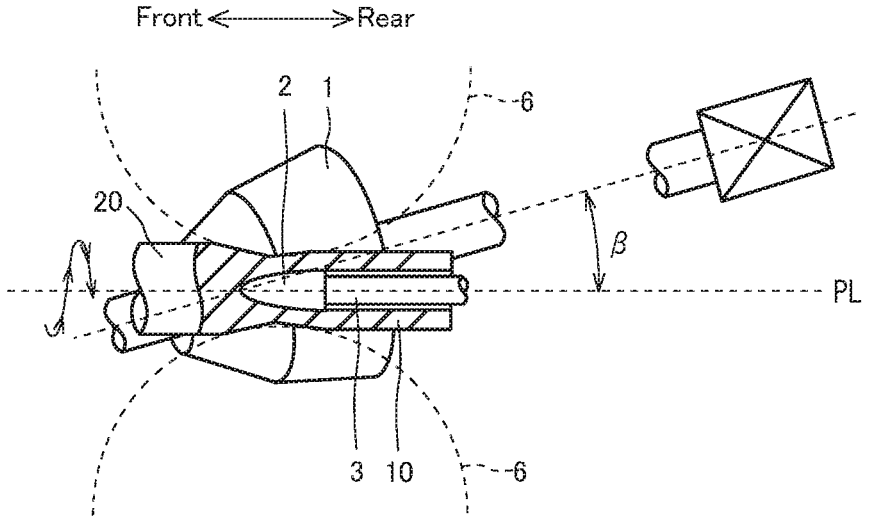
FIG. 9 is a side view of a vicinity of an skewed roll of the piercing mill orthogonal to FIG. 1.

FIG. 8 is a side view of the piercing mill 100, and FIG. 1 is the side view of a vicinity of the skewed rolls 1 of the piercing mill 100 illustrated in FIG. 8. FIG. 9 is a side view of a vicinity of the skewed rolls 1 seen from a direction orthogonal to FIG. 8, of the piercing mill 100 illustrated in FIG. 8. As described above, the piercing mill 100 is a piercer, or an elongator. In FIG. 1, and FIG. 8 to FIG. 10, an entrance side of the piercing mill 100 is defined as a "front" of the piercing mill 100, and a outlet side of the piercing mill 100 is defined as a "rear" of the piercing mill 100.

Referring to FIG. 8, the piercing mill 100 includes the plurality of skewed rolls 1, the plug 2, and the mandrel bar 3.

The plurality of skewed rolls 1 are disposed around the pass line PL. In FIG. 1, the pass line PL is disposed between a pair of skewed rolls 1. Here, the pass line PL means an imaginary line segment, where a center axis of the Nb-containing steel material (a round billet or a hollow shell) 20 passes, during piercing-rolling or elongation rolling. In FIG. 8 the skewed roll 1 is a cone type skewed roll. However, the skewed roll 1 is not limited to the cone type, but may be of a barrel type. Further, two or more skewed rolls 1 may be disposed. Referring to FIG. 1 and FIG. 9, each of the skewed rolls 1 has a feed angle β (FIG. 9) and a toe angle γ (FIG. 1) with respect to the pass line PL. The feed angle is an acute angle to the pass line PL. Likewise, the toe angle γ is an acute angle to the pass line PL.

The plug 2 is disposed on the pass line PL, between the two skewed rolls 1. In the present specification, "the plug 2 is disposed on the pass line PL" means that the plug 2 overlaps the pass line PL when the piercing mill 100 is seen from the entrance side to the outlet side (seen from the front to the rear). A center axis of the plug 2 more preferably corresponds to the pass line PL.

The plug 2 has a bullet shape. An outside diameter of a front portion of the plug 2 is smaller than an outside diameter of a rear portion of the plug 2. Here, the front portion of the plug 2 means a portion that is more front than a central position in a longitudinal direction of the plug 2. The rear portion of the plug 2 means a portion that is more rear than the central position in a front-rear direction of the plug 2. The front portion of the plug 2 is disposed at the entrance side of the piercing mill 100, and the rear portion of the plug 2 is disposed at the outlet side of the piercing mill 100.

The mandrel bar 3 is disposed on the pass line PL at the outlet side of the piercing mill 100, and extends along the pass line PL. Here, "the mandrel bar 3 is disposed on the pass line PL" means that the mandrel bar 3 overlaps the pass line PL when the piercing mil 100 is seen from the entrance side to the outlet side. A center axis of the mandrel bar 3 more preferably corresponds to the pass line PL.

A fore end of the mandrel bar 3 is connected to a rear end of the plug 2. For example, the fore end of the mandrel bar 3 is connected to a rear end surface central portion of the plug 2. A connecting method is not specially limited. For example, screws are formed at the rear end of the plug 2, and the fore end of the mandrel bar 3, and the mandrel bar 3 is connected to the plug 2 by these screws. The mandrel bar 3 may be connected to the rear end surface center portion of the plug 2 by other methods than the screws. In other words, the connection method is not specially limited.

The piercing mill 100 may further include a pusher 4. The pusher 4 is disposed along the pass line PL, at a front of the piercing mill 100. The pusher 4 includes a mechanism that pushes the Nb-containing steel material 20 (round billet) toward the plug 2. The pusher 4 includes, for example, a cylinder main body 41, a cylinder shaft 42, a connection member 43, and a rod 44. The rod 44 is connected to the cylinder shaft 42 rotatably in a circumferential direction by the connection member 43. The connection member 43 includes a bearing for making the rod 44 rotatable in the circumferential direction, for example. The cylinder main body 41 is of a hydraulic type or an electric type, and causes the cylinder shaft 42 to advance and retreat. The pusher 4 causes an end face of the rod 44 to abut on an end face of the Nb-containing steel material (a round billet or a hollow shell) 20, and causes the cylinder shaft 42 and the rod 44 to advance by the cylinder main body 41. Thereby, the pusher 4 pushes and advances the Nb-containing steel material 20 toward the plug 2.

The pusher 4 pushes and advances the Nb-containing steel material 20 along the pass line PL, and pushes the Nb-containing steel material 20 between the plurality of skewed rolls 1. When the Nb-containing steel material 20 is caught in the plurality of skewed rolls 1, the skewed rolls 1 push the Nb-containing steel material 20 onto the plug 2 while rotating the Nb-containing steel material 20 in the circumferential direction of the Nb-containing steel material 20 (see arrows in front of the piercing mill 100 in FIG. 9). When the piercing mill 100 is a piercer, the plurality of skewed rolls 1 push the round billet that is the Nb-containing steel material 20 onto the plug 2 while rotating the round billet in the circumferential direction, and carries out piercing-rolling to produce a hollow shell. When the piercing mill 100 is an elongator, the plurality of skewed rolls 1 push (insert) the plug 2 into the hollow shell that is the Nb-containing steel material 20, and carries out elongation rolling (expansion rolling).

The piercing mill 100 may further include an entrance trough 5. In the entrance trough 5, the Nb-containing steel material (a round billet or a hollow shell) 20 before piercing-rolling is placed. As illustrated in FIG. 9, the piercing mill 100 may include a plurality of guide rolls 6 around the pass line PL. The plug 2 is disposed between the plurality of guide rolls 6. Further, around the pass line PL, the guide rolls 6 are disposed between the plurality of skewed rolls 1. The guide roll 6 is a disc roll, for example.

[Configuration of Mandrel Bar 3]

Figure 10:
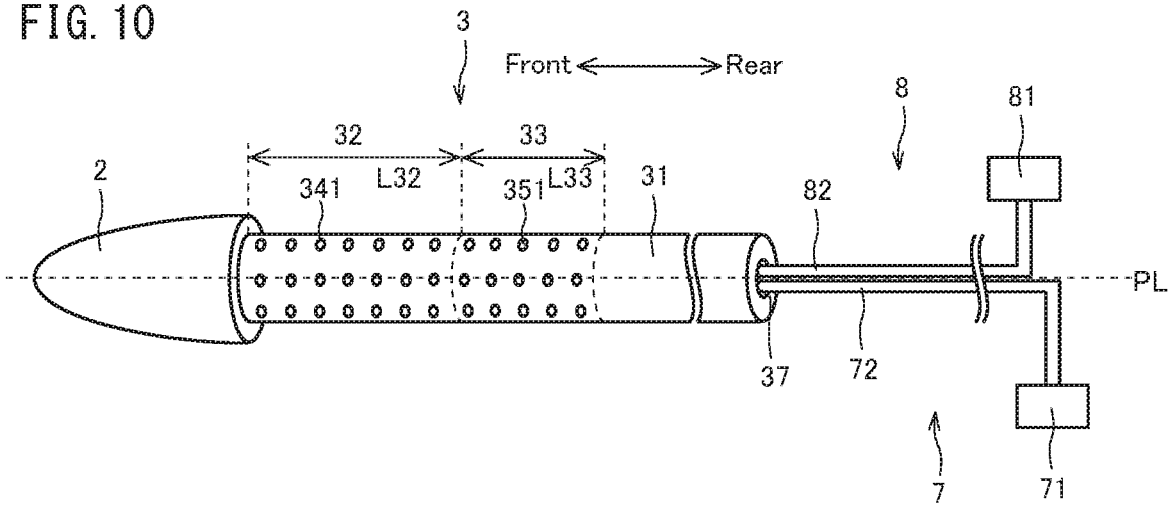
FIG. 10 is a side view of a plug and a mandrel bar in FIG. 8.

FIG. 10 is an enlarged view of the plug 2 and the mandrel bar 3 in FIG. 8. Referring to FIG. 10, the mandrel bar 3 of the piercing mill 100 receives supply of a cooling liquid from a cooling liquid supply device 7. The cooling liquid supply device 7 supplies the cooling liquid for cooling an inner surface of the hollow shell 10 of the Nb-containing steel during piercing-rolling or elongation rolling to the mandrel bar 3. The cooling liquid supply device 7 includes a supply machine 71 and a pipe 72. The supply machine 71 includes a storage tank that stores the cooling liquid, and a pump that supplies the cooling liquid in the storage tank to the pipe 72. The pipe 72 connects the mandrel bar 3 and the supply machine 71. The pipe 72 transfers the cooling liquid that is fed from the supply machine 71 to the mandrel bar 3. Here, the cooling liquid is not specially limited, as long as the cooling liquid can cool the hollow shell 10 of the Nb-containing steel. The cooling liquid is preferably water.

The mandrel bar 3 extends along the pass line PL from a rear end surface central portion of the plug 2. The mandrel bar 3 includes a bar main body 31 in a bar shape. The bar main body 31 includes a cooling zone 32 and a contact suppression zone 33.

The cooling zone 32 is disposed at a fore end portion of the bar main body 31. Specifically, the cooling zone 32 is a range having a specific length L32 from a fore end of the bar main body 31 (that is, a connection position to the rear end of the plug 2) to a rear of the mandrel bar 3, in an axial direction of the mandrel bar 3 (in a front-rear direction of the mandrel bar 3). The specific length L32 of the cooling zone 32 is not specially limited. The specific length L32 of the cooling zone 32 is, for example, 1/10 or more of an entire length of the mandrel bar 3, and 1/2 or less of the entire length of the mandrel bar 3. In another example, when a length of the hollow shell that is produced is 6 m, the length L32 of the cooling zone 32 is 0.6 m to 3.0 m, for example, is more preferably 1.0 m to 2.5 m, and is 2 m as an example.

The contact suppression zone 33 is adjacent to the cooling zone 32, and is disposed at a rear (opposite side to the plug 2) of the cooling zone 32. A specific length L33 of the contact suppression zone 33 is not specially limited. The specific length L33 of the contact suppression zone 33 may be the same length as the specific length L32 of the cooling zone 32, or may be longer or shorter than the specific length L32. In the bar main body 31, a portion other than the cooling zone 32 may be the contact suppression zone 33. The contact suppression zone 33 may not be provided.

Figure 11:
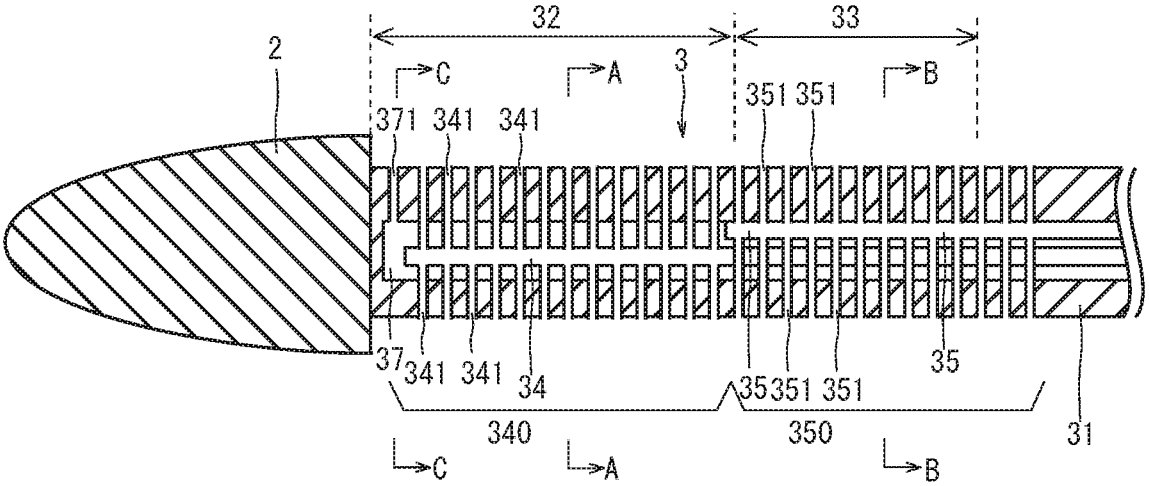
FIG. 11 is a sectional view along a plane including a center axis in FIG. 10.

FIG. 11 is a sectional view (vertical sectional view) including the plug 2 and a center axis of the mandrel bar 3 illustrated in FIG. 10. Referring to FIG. 11, the mandrel bar 3 further includes a cooling liquid flow path 34 and an inner surface cooling mechanism 340. The cooling liquid flow path 34 is formed in the bar main body 31, and passes the cooling liquid which is supplied from the cooling liquid supply device 7 to an inside. The cooling liquid flow path 34 extends to the inside of the bar main body 31 along an axial direction of the bar main body 31. The cooling liquid flow path 34 connects to the pipe 72, and receives supply of the cooling liquid from the pipe 72.

The inner surface cooling mechanism 340 is disposed in the cooling zone 32 corresponding to afore end portion of the bar main body 31. In the present example, the inner surface cooling mechanism 340 includes a plurality of inner surface cooling liquid ejection holes 341. The plurality of inner surface cooling liquid ejection holes 341 connect to the cooling liquid flow path 34. The plurality of inner surface cooling liquid ejection holes 341 receive supply of the cooling liquid from the cooling liquid supply device 7, and eject the cooling liquid to an outside of the cooling zone 32 during piercing-rolling or elongation-rolling. Though not illustrated, the inner surface cooling mechanism 340 may include a plurality of ejection nozzles, and each of the ejection nozzles may have the inner surface cooling liquid ejection hole 341.

The mandrel bar 3 may further include an inner surface damming mechanism 350. When the mandrel bar 3 includes the inner surface damming mechanism 350, the inner surface damming mechanism 350 is disposed in the contact suppression zone 33. During piercing-rolling or elongation-rolling, the inner surface damming mechanism 350 restrains an inner surface portion that is after exiting the cooling zone 32, in the inner surface of the hollow shell, from contacting the cooling liquid which is ejected from the inner surface cooling mechanism 340.

In the present embodiment, the inner surface damming mechanism 350 ejects compression gas from the contact suppression zone 33, and dams or blows away the cooling liquid that is to flow rearward from the cooling zone 32, and thereby restrains the cooling liquid from contacting the inner surface portion of the hollow shell in the contact suppression zone 33, during piercing-rolling or elongation rolling.

Specifically, as illustrated in FIG. 10, the mandrel bar 3 further receives supply of the compression gas from a compression gas supply device 8. The compression gas supply device 8 supplies compression gas for blowing away the cooling liquid to the bar main body 31. The compression gas supply device 8 includes, for example, an accumulator 81 that accumulates high-pressure gas, and a pipe 82. The pipe 82 connects the accumulator 81 and the bar main body 31. The pipe 82 transfers the compression gas that is fed from the accumulator 81 to the bar main body 31. Here, the compression gas is compression air, for example. The compression gas may be inert gas such as argon gas.

Referring to FIG. 11, the mandrel bar 3 further includes a gas flow path 35. The gas flow path 35 extends to inside of the bar main body 31 along the axial direction of the bar main body 31. The gas flow path 35 connects to the pipe 82, and receives supply of the compression gas from the pipe 82.

In the present example, the inner surface damming mechanism 350 includes a plurality of compression gas ejection holes 351. The plurality of compression gas ejection holes 351 connect to the gas flow path 35, and eject the compression gas to outside of the contact suppression zone 33 during piercing-rolling or elongation-rolling. Though not illustrated, the inner surface damming mechanism 350 may include a plurality of ejection nozzles, and each of the ejection nozzles may have the compression gas ejection hole 351.

Figure 12:
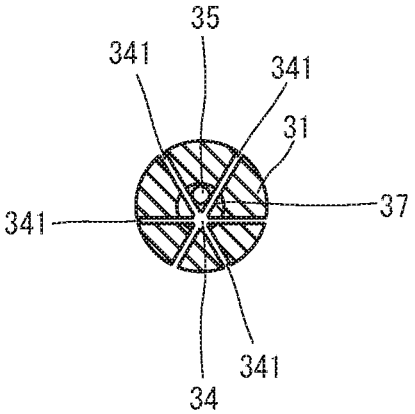
FIG. 12 is a sectional view along a line segment A-A in FIG. 11.

FIG. 12 is a sectional view perpendicular to the axial direction of the mandrel bar 3, in a line segment A-A in the cooling zone 32 in FIG. 11. Referring to FIG. 12, the cooling liquid flow path 34 is disposed in a center portion of the bar main body 31, side by side with the gas flow path 35. The plurality of inner surface cooling liquid ejection holes 341 are arranged in the circumferential direction of the bar main body 31. The plurality of inner surface cooling liquid ejection holes 341 may be arranged at equal intervals in the circumferential direction of the bar main body 31, or may be arranged irregularly. The inner surface cooling liquid ejection holes 341 are preferably arranged at equal intervals in the circumferential direction of the bar main body 31. The respective inner surface cooling liquid ejection holes 341 connect to the cooling liquid flow path 34. As illustrated in FIG. 10 and FIG. 11, in the present embodiment, the plurality of inner surface cooling liquid ejection holes 341 are arranged in the circumferential direction and an axial direction of the bar main body 31, in the cooling zone 32. However, the plurality of inner surface cooling liquid ejection holes 341 may be arranged only in at least the circumferential direction of the bar main body 31.

Figure 13:
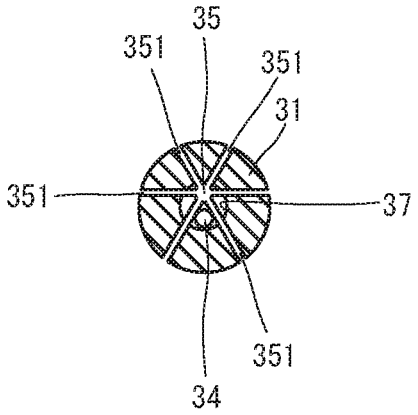
FIG. 13 is a sectional view along a line segment B-B in FIG. 11.

FIG. 13 is a sectional view perpendicular to the axial direction of the mandrel bar 3, in a line segment B-B in the contact suppression zone 33 in FIG. 11. Referring to FIG. 13, similarly to the sectional view (FIG. 12) in the cooling zone 32, the gas flow path 35 is also disposed in the center portion of the bar main body 31, side by side with the cooling liquid flow path 34 in the sectional view of an inside of the contact suppression zone 33. The plurality of gas ejection holes 351 are arranged in the circumferential direction of the bar main body 31. The plurality of gas ejection holes 351 may be arranged at equal intervals in the circumferential direction of the bar main body 31, or may be arranged irregularly. The gas ejection holes 351 are preferably arranged at equal intervals in the circumferential direction of the bar main body 31. The respective gas ejection holes 351 connect to the gas flow path 35. As illustrated in FIG. 11 and FIG. 13, in the present embodiment, the plurality of gas ejection holes 351 are arranged in the circumferential direction and the axial direction of the bar main body 31, in the contact suppression zone 33. However, the plurality of gas ejection holes 351 may be arranged only in at least the circumferential direction of the bar main body 31.

Figure 14:
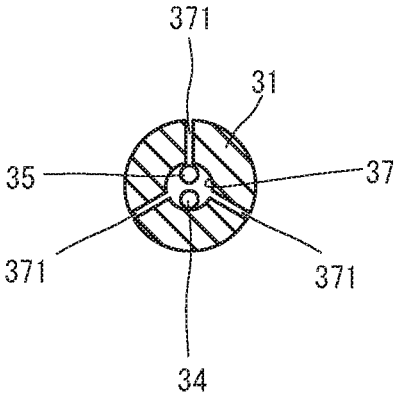
FIG. 14 is a sectional view along a line segment C-C in FIG. 11.

Returning to FIG. 11, the mandrel bar 3 may further include a liquid drain flow path 37 in the bar main body 31. The liquid drain flow path 37 extends along the axial direction of the bar main body 31, in the bar main body 31. The liquid drain flow path 37 extends to a rear end face (an end face at an opposite side to a fore end face connected to the plug 2) of the bar main body 31, for example. FIG. 14 is a sectional view perpendicular to the axial direction of the mandrel bar, in a line segment C-C in the cooling zone 32 in FIG. 11. Referring to FIG. 14, the liquid drain flow path 37 is formed in a central portion of the bar main body 31, and houses the cooling liquid flow path 34 and the gas flow path 35 therein. However, the liquid drain flow path 37 may not house the cooling liquid flow path 34 and the gas flow path 35 therein.

The mandrel bar 3 further includes one or a plurality of liquid drain holes 371 in the cooling zone 32. When the plurality of liquid drain holes 371 are formed, the plurality of liquid drain holes 371 may be arranged in the circumferential direction of the bar main body 31 as illustrated in FIG. 14, or may be arranged in the axial direction of the bar main body 31 though not illustrated. Only one liquid drain hole 371 may be formed.

A liquid drain mechanism including the liquid drain flow path 37 and the liquid drain holes 371 recovers part of the cooling liquid that is ejected to the inner surface portion of the hollow shell which is passing through the cooling zone 32 during piercing-rolling and elongation rolling.

[Cooling Method of Hollow Shell by Inner Surface Cooling Mechanism 340]

Figure 15:
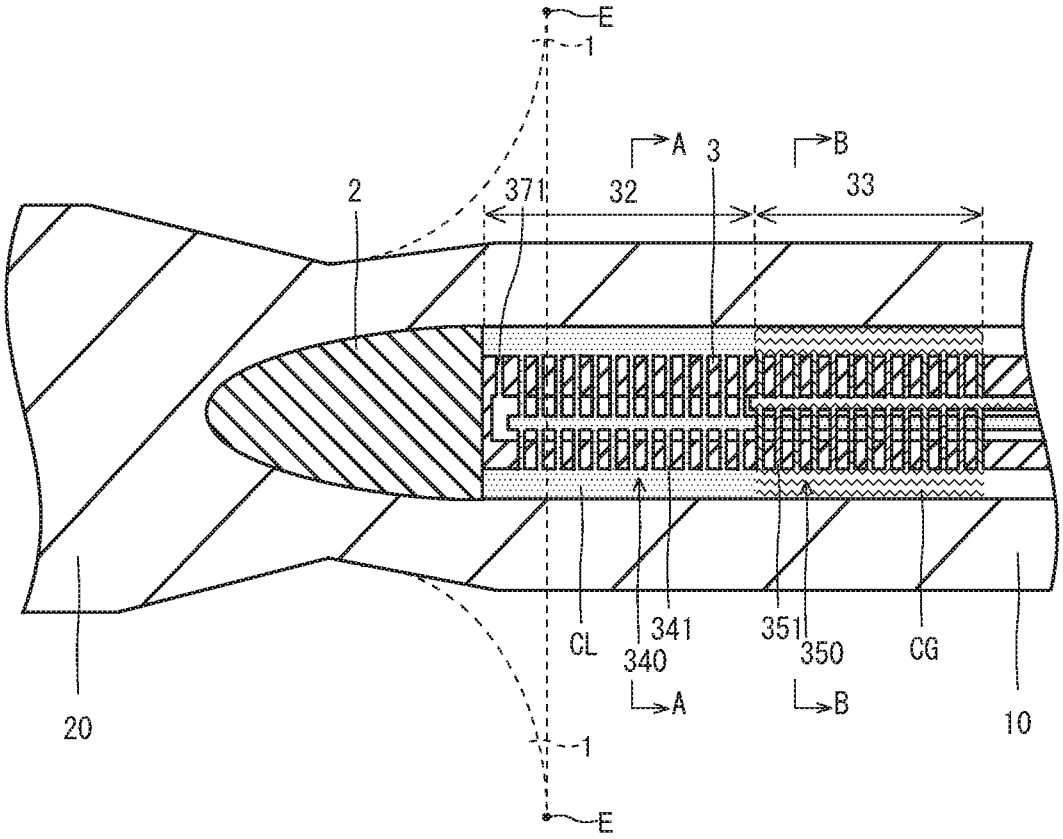
FIG. 15 is a schematic view for explaining cooling during piercing-rolling or elongation rolling.
Figure 16:
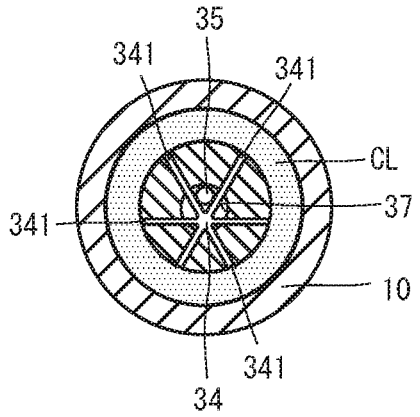
FIG. 16 is a sectional view along a line segment A-A in FIG. 15.

FIG. 15 is a vertical sectional view of the hollow shell, the plug, and the mandrel bar during piercing-rolling or elongation rolling, on the outlet side of the piercing mill 100. Referring to FIG. 15, the piercing mill 100 cools an inner surface of a hollow shell portion of the Nb-containing steel which passes between rear ends E of the plurality of skewed rolls 1 in the front-rear direction, in the hollow shell 10 of the N b-containing steel which is immediately after piercing-rolling or immediately after elongation rolling, during piercing-rolling or elongation rolling, with the cooling liquid which is ejected from the inner surface cooling mechanism 340. Specifically, the inner surface of the hollow shell portion which passes through the cooling zone 32 of the mandrel bar 3 is cooled with the cooling liquid by the inner surface cooling mechanism 340. In this case, as illustrated in FIG. 16 which is a sectional view along a line segment A-A in FIG. 15, a cooling liquid CL that is ejected from the inner surface cooling mechanism 340 exists in a gap between the hollow shell 10 and the mandrel bar 3. The cooling liquid CL reduces the outer surface temperature of the hollow shell 10 to 1000° C. or less within 15.0 seconds after the hollow shell 10 passes between the rear ends E of the skewed rolls 1 in the front-rear direction of the piercing mill 100 by cooling the hollow shell 10 once the wall middle temperature of the hollow shell 10 becomes more than 1050° C. by processing-incurred heat being generated by piercing-rolling or elongation rolling.

Figure 17:
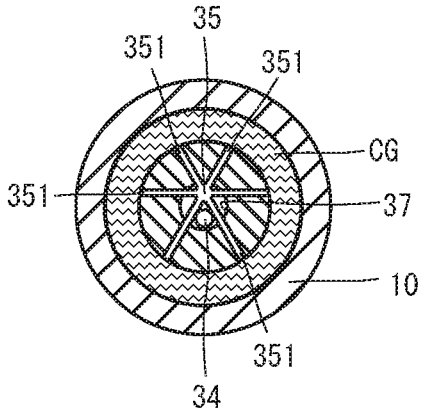
FIG. 17 is a sectional view along a line segment B-B in FIG. 15.

As described above, the mandrel bar 3 may not include the inner surface damming mechanism 350. However, when the mandrel bar 3 includes the inner surface damming mechanism 350, the inner surface damming mechanism 350 further restrains the cooling liquid from contacting the inner surface of the hollow shell 10, in the contact suppression zone 33. Specifically, during piercing-rolling or during elongation rolling, the inner surface damming mechanism 350 ejects the compression gas to outside of the bar main body 31 from the gas ejection holes 351 in the contact suppression zone 33. Therefore, when the cooling liquid which is ejected from the cooling liquid ejection holes 341 of the cooling zone 32 is to flow to the inner surface of the hollow shell 10 which is after exiting the cooling zone 32, the cooling liquid is blown away by the compression gas which is ejected in the contact suppression zone 33 which is adjacent to and behind the cooling zone 32, and the cooling liquid is restrained from contacting the inner surface of the hollow shell 10 which is after exiting the cooling zone 32. The compression gas that is ejected from the plurality of gas ejection holes 351 in the contact suppression zone 33 further dams the cooling liquid in the cooling zone 32 from flowing to the rear (that is, the contact suppression zone 33) of the cooling zone 32. Specifically, as illustrated in FIG. 17 that is a sectional view on a line segment B-B in FIG. 15, in the contact suppression zone 33, compression gas CG that is ejected from the gas ejection holes 351 is filled in a gap between the outer surface of the mandrel bar 3 and the inner surface of the hollow shell 10. The filled compression gas CG dams entry of the cooling liquid CL which is ejected from the cooling zone 32 into the contact suppression zone 33. Thereby, the hollow shell 10 is cooled by the cooling liquid in the cooling zone 32, and does not receive cooling by the cooling liquid in the other area than the cooling zone 32. Therefore, the cooling time period by the cooling liquid can be restrained from increasing or decreasing according to a position in the longitudinal direction of the hollow shell. As a result, a temperature difference between the fore end portion and the rear end portion of the hollow shell 10 after piercing-rolling or elongation rolling can be reduced.

When the inner surface damming mechanism 350 is included, the cooling liquid CL is further filled in the gap between the outer surface of the mandrel bar 3 and the inner surface of the hollow shell 10, in the cooling zone 32. The cooling liquid CL continues to be ejected from the cooling liquid ejection holes 341 in a state where the cooling zone 32 is filled with the cooling liquid CL, and therefore the filled cooling liquid CL convects. Therefore, the inner surface of the hollow shell 10 in the cooling zone 32 is further cooled during piercing-rolling or elongation rolling.

The aforementioned inner surface damming mechanism 350 has a configuration of ejecting compression gas, but the inner surface damming mechanism 350 may have another configuration. For example, referring to FIG. 18, the inner surface damming mechanism 350 may include an inner surface damming member 352 in place of the plurality of gas ejection holes 351.

The inner surface damming member 352 is disposed adjacently to the rear end of the cooling zone 32. The inner surface damming member 352 extends in the circumferential direction of the bar main body 31. Accordingly, when the mandrel bar 3 is seen from the axial direction, an outer edge of the inner surface damming member 352 is in a circular shape. When the mandrel bar 3 is seen from a direction perpendicular to the axial direction, a height H352 of the inner surface damming member 352 is less than a differential value $H_{2-3}$ obtained by subtracting a radius of the mandrel bar 3 in a position where the inner surface damming member 352 is disposed from a maximum radius of the plug 2. The height H352 of the inner surface damming member 352 is preferably ½ of the differential value $H_{2-3}$ or more. In other words, during piercing-rolling or elongation rolling, the inner surface damming member 352 does not roll the inner surfaces of the hollow shell 10.

A material of the inner surface damming member 352 is, for example, glass wool. The material of the inner surface damming member 352 is not limited to glass wool. A material having a higher fusing point than the inner surface temperature of the hollow shell 10 during piercing-rolling or elongation rolling is sufficient. The fusing point of the material of the inner surface damming member 352 is preferably 1100° C. or more.

Figure 18:
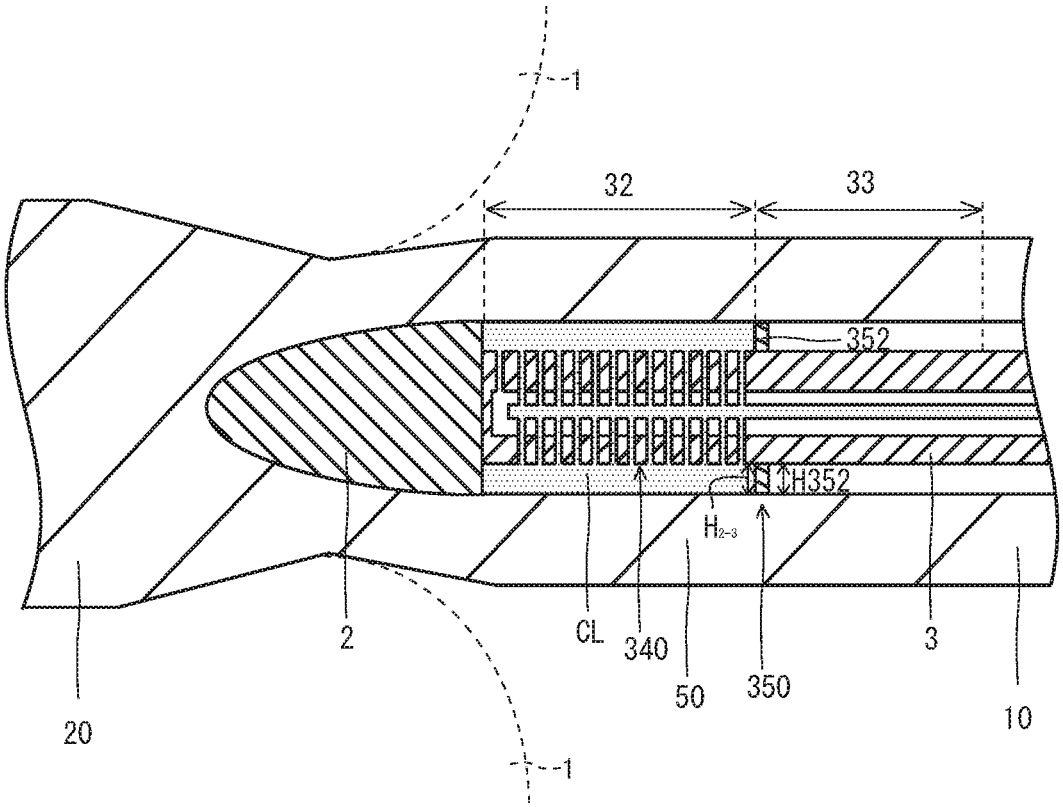
FIG. 18 is a schematic view illustrating a configuration of another mandrel bar different from FIG. 11.

In the piercing mill 100 illustrated in FIG. 18, the inner surface damming member 352 also suppresses entry of the cooling liquid CL into the contact suppression zone 33, and physically dams the cooling liquid CL in the cooling zone 32, during piercing-rolling or elongation rolling. Therefore, a similar effect to the effect in the case where the inner surface damming mechanism 350 has the plurality of compression gas ejection holes 351 (see FIG. 15) is obtained.

[Outer Surface Cooling Mechanism]

In the aforementioned explanation, during piercing-rolling or elongation rolling, the hollow shell immediately after rolling is cooled from the inner surface of the hollow shell by using the inner surface cooling mechanism 340. However, the hollow shell 10 after piercing-rolling or elongation rolling may be cooled from the outer surface by using an outer surface cooling mechanism 400 in place of the inner surface cooling mechanism 340.

Figure 19:
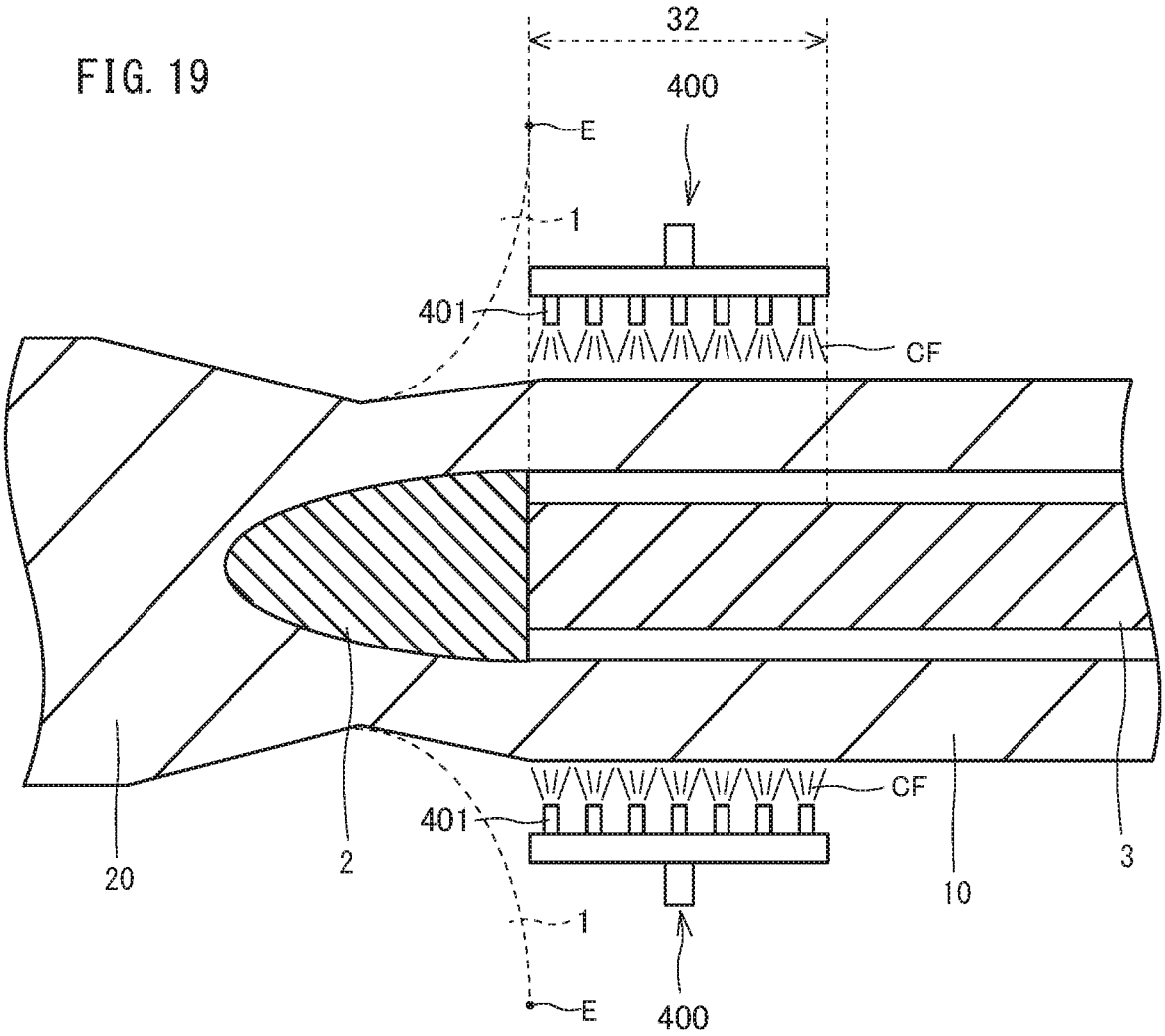
FIG. 19 is a side view of a vicinity of a skewed roll of a piercing mill including an outer surface cooling mechanism.
Figure 20:
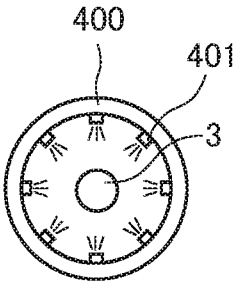
FIG. 20 is a front view of the outer surface cooling mechanism illustrated in FIG. 19.

FIG. 19 is a vertical sectional view of the piercing mill 100 during piercing-rolling or elongation rolling, in a vicinity of the skewed roll 1, which is different from FIG. 15. In FIG. 19, the mandrel bar 3 does not include the inner surface cooling mechanism 340 and the inner surface damming mechanism 350. The piercing mill 100 newly includes the outer surface cooling mechanism 400. FIG. 20 is a front view of the outer surface cooing mechanism 400. The outer surface cooling mechanism 400 is disposed around the cooling zone 32 of the mandrel bar 3, on the outlet side of the piercing mill 100.

The outer surface cooling mechanism 400 includes a plurality of outer surface cooling ejection holes 401 that are disposed around the pass line PL. The outer surface cooling mechanism 400 connects to the cooling liquid supply device 7 via a pipe not illustrated.

[Cooling Method by Outer Surface Cooling Mechanism 400]

In this case, during piercing-rolling or elongation rolling, the outer surface cooling mechanism 400 ejects the cooling liquid from the outer surface cooling ejection holes 401, and cools the outer surface of the hollow shell portion immediately after piercing-rolling or elongation rolling. Thereby the outer surface temperature of the hollow shell 10 is reduced to 1000° C. or less within 15.0 seconds after the hollow shell 10 passes between rearmost ends F of the skewed rolls 1 in the front-rear direction of the piercing mill 100.

[Front Outer Surface Damming Mechanism 600]

Figure 21:
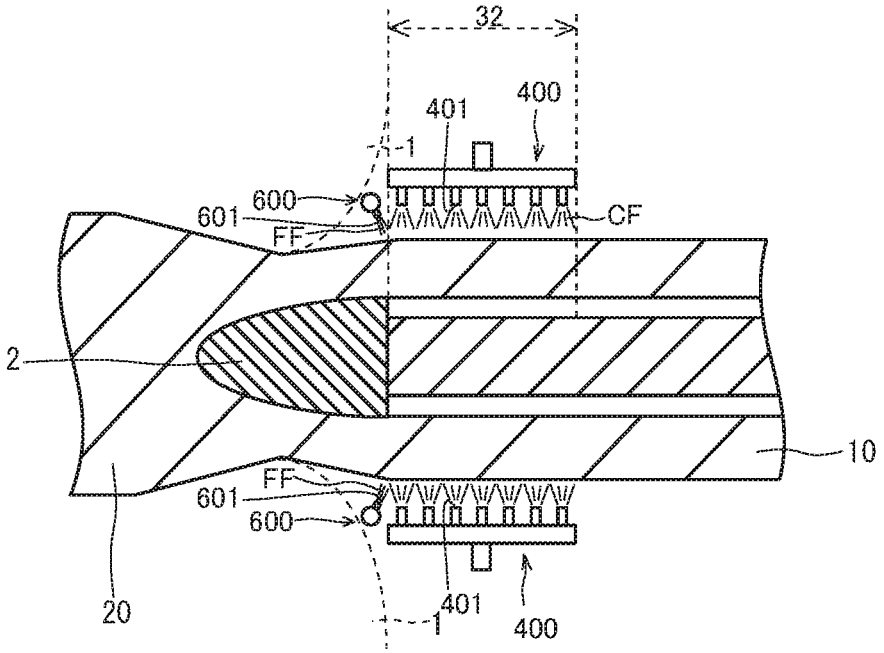
FIG. 21 is a side view of a vicinity of a skewed roll of a piercing mill including the outer surface cooling mechanism and a front outer surface damming mechanism.

The piercing mill 100 may further include a front outer surface damming mechanism 600 illustrated in FIG. 21. The front outer surface damming mechanism 600 is disposed around the pass line PL and the mandrel bar 3, on the outlet side of the skewed rolls 1, and in front of the outer surface cooling mechanism 400, and restrains a cooling liquid CF from contacting the outer surface portion of the hollow shell 10 which is located in front of the cooling zone 32, when the outer surface cooling mechanism 400 cools the hollow shell 10.

Figure 22:
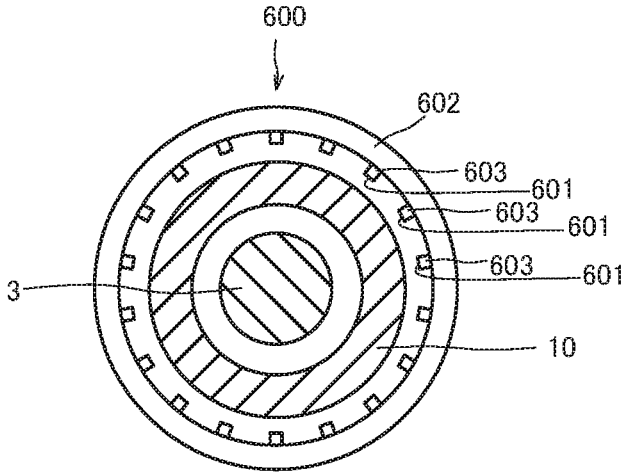
FIG. 22 is a front view of the front outer surface damming mechanism illustrated in FIG. 21.

FIG. 22 is a front view of the front outer surface damming mechanism 600 (a view seen in an advancing direction of the hollow shell 10, that is, a view seen from the entrance side of the skewed rolls 1 to the outlet side). Referring to FIG. 21 and FIG. 22, the front outer surface damming mechanism 600 is disposed around the pass line PL and around the mandrel bar 3. Therefore, during piercing-rolling or elongation rolling, the front outer surface damming mechanism 600 is disposed around the hollow shell 10 which is piercing-rolled or elongation-rolled.

The front outer surface damming mechanism 600 illustrated in FIG. 21 and FIG. 22 includes a main body 602, and a plurality of front outer surface damming fluid ejection holes 601. In the present example, the main body 602 is annular or cylindrical, and has one or a plurality of front outer surface damming fluid paths that allows a front damming fluid to pass through.

The plurality of front outer surface damming fluid ejection holes 601 are disposed around the pass line PL and the mandrel bar 3, and is disposed around the hollow shell 10 which is piercing-rolled or elongation-rolled. In the present example, the front outer surface damming fluid ejection holes 601 are formed in front ends of a plurality of front outer surface damming fluid ejection nozzles 603. However, the front outer surface damming fluid ejection holes 601 may be directly formed in the main body 602. In the present example, the front outer surface damming fluid ejection nozzles 603 that are disposed around the mandrel bar 3 are connected to the main body 602.

Referring to FIG. 21 and FIG. 22, the plurality of front outer surface damming fluid ejection holes 601 face the mandrel bar 3. Therefore, when the hollow shell 10 which is piercing-rolled or elongation-rolled passes inside of the front outer surface damming mechanism 600, the plurality of front outer surface damming fluid ejection holes 601 face the outer surface of the hollow shell 10.

The plurality of front outer surface damming fluid ejection holes 601 are arranged in a circumferential direction, around the mandrel bar 3. The plurality of front outer surface damming fluid ejection holes 601 are preferably disposed at equal intervals around the mandrel bar 3. The front outer surface daemon mechanism 600 ejects the front damming fluid FF toward the outer surface portion of the hollow shell 10 at a fore end position of the cooling zone 32, from the front outer surface damming fluid ejection holes 601.

When the piercing mill 100 includes the front outer surface damming mechanism 600 having the above configuration, characteristics as follows are obtained.

During piercing-rolling or elongation rolling, the outer surface cooling mechanism 400 ejects the cooling liquid CF to the outer surface portion of the hollow shell 10 in the cooling zone 32, of the outer surface of the hollow shell 10 which is piercing-rolled or elongation-rolled, and cools the hollow shell 10. At this time, there can be a case where the cooling liquid CF that is ejected to the outer surface portion of the hollow shell 10 in the cooling zone 32 contacts the outer surface portion of the hollow shell 10, and thereafter flows on the outer surface of the hollow shell 10, and the cooling liquid CF contacts the outer surface portion of the hollow shell 10 in front of the cooling zone 32. Such a contact of the cooling liquid CF to the outer surface portion other than the cooling zone 32 can occur irregularly.

Thus, during piercing-rolling or elongation rolling, the front outer surface damming mechanism 600 restrains the cooling liquid CF which still flows on the outer surface of the hollow shell 10 after contacting the outer surface portion of the hollow shell 10 in the cooling zone 32 from flowing to the outer surface portion of the hollow shell 10 which is before entering the cooling zone 32 during piercing-rolling or elongation rolling. Specifically, referring to FIG. 21 and FIG. 22, the front outer surface damming mechanism 600 ejects the front damming fluid FF toward the outer surface portion of the hollow shell 10 which is located in a vicinity of the entrance side of the cooling zone 32. Thereby, the front damming fluid FF dams the cooling liquid CF from flowing to the outer surface portion of the hollow shell 10 which is before entering the cooling zone 32. In other words, the front damming fluid FF which is ejected from the front outer surface damming fluid ejection holes 601 plays a part of a dam (protection wall) to the cooling liquid CF which is to flow out forward from the cooling zone 32. Therefore, the cooling liquid CF can be restrained from contacting the outer surface portion of the hollow shell 10 in front of the cooling zone 32, and a temperature variation in the axial direction of the hollow shell 10 can be further reduced.

Referring to FIG. 21, the front outer surface damming fluid ejection hole 601 preferably ejects the front damming fluid FF diagonally rearward toward the outer surface portion of the hollow shell 10 which is located in a vicinity of the entrance side of the cooling zone 32.

In this case, during piercing-rolling and elongation rolling, the front damming fluid FF forms a dam extending diagonally rearward to the outer surface of the hollow shell 10 from the front outer surface damming fluid ejection holes 601. Therefore, the dam (protection wall) by the front damming fluid FF dams the cooling liquid CF that is to flow forward of the cooling zone 32 after contacting the outer surface portion of the hollow shell 10 in the cooling zone 32. Further, much of the front damming fluid FF that configures the dam contacts the outer surface portion of the hollow shell 10 which is located in a vicinity of the entrance side of the cooing zone 32, and thereafter flows into the cooling zone 32 in rear. Therefore, the front damming fluid FF which is used as the dam can be restrained from contacting the outer surface portion of the hollow shell 10 in front of the cooling zone 32.

The front damming fluid FF is gas and/or liquid. In other words, as the front outer surface damming fluid, gas may be used, a liquid may be used, or both gas and a liquid may be used. Here, gas is air or inert gas, for example. An inert gas is argon gas, or nitrogen gas, for example. When gas is used as the front damming fluid FF, only air may be used, only inert gas may be used, or both air and inert gas may be used. Further, as inert gas, only one kind of inert gas (for example, only argon gas, only nitrogen gas) may be used, or a plurality of inert gases may be mixed and used. When a liquid is used as the front damming fluid FF, the liquid is water or oil, for example, and is preferably water.

The front damming fluid FF may be the same as the cooling liquid CF, or may be different from the cooling liquid CF. The front outer surface damming mechanism 600 receives supply of the front damming fluid FF from a fluid supply source not illustrated. The front damming fluid FF which is supplied from the fluid supply source is ejected from the front outer surface damming fluid ejection holes 601 through the fluid path in the main body 602 of the front outer surface damming mechanism 600.

[Rear Outer Surface Damming Mechanism 500]

Figure 23:
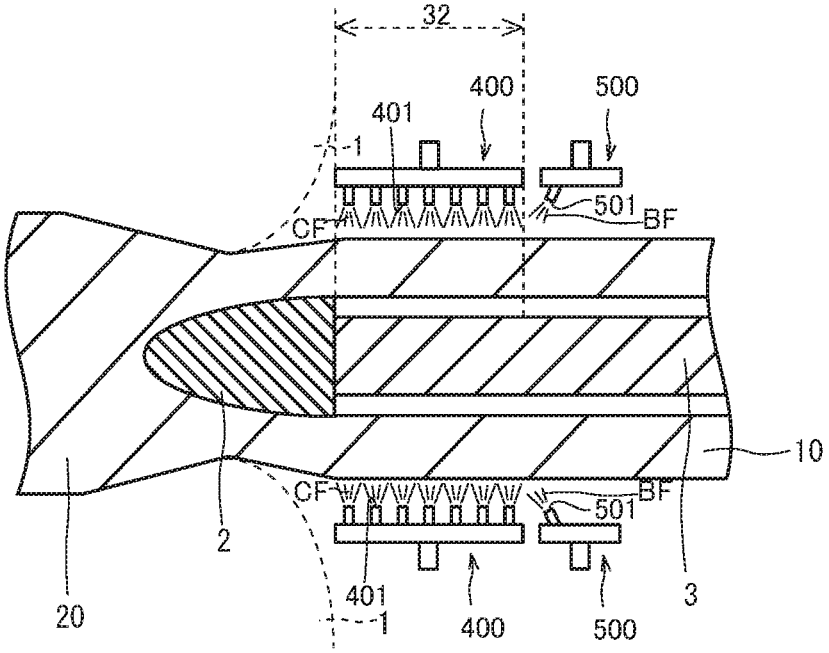
FIG. 23 is a side view of a vicinity of a skewed roll of a piercing mill including the outer surface cooling mechanism and a rear outer surface damming mechanism.

The piercing mill 100 may further include a rear outer surface damming mechanism 500 illustrated in FIG. 23. The rear outer surface damming mechanism 500 is disposed around the pass line PL and the mandrel bar 3 on the outlet side of the skewed roll 1 and behind the outer surface cooling mechanism 400, and restrains the cooling liquid CF from contacting an outer surface portion of the hollow shell 10 that is located behind the cooling zone 32 during the outer surface cooling mechanism 400 cools the hollow shell 10.

Figure 24:
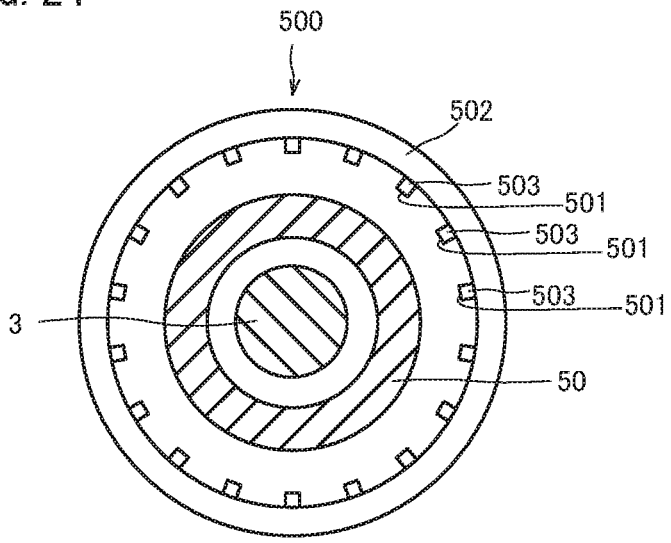
FIG. 24 is a front view of the rear outer surface damming mechanism in FIG. 23.

FIG. 24 is a front view of the rear outer surface damming mechanism 500 (a view seen in an advancing direction of the hollow shell 10, that is, a view seen from the entrance side to the outlet side of the skewed rolls 1). Referring to FIG. 23 and FIG. 24, the rear outer surface damming mechanism 500 is disposed around the mandrel bar 3. Therefore, during piercing-rolling or elongation rolling, the rear outer surface damming mechanism 500 is disposed around the hollow shell 10 which is piercing-rolled, or elongation-rolled.

The rear outer surface damming mechanism 500 illustrated in FIG. 23 and FIG. 24 includes a main body 502 and a plurality of rear damming fluid ejection holes 501. In the present example, the main body 502 is annular or cylindrical, and has one or a plurality of rear damming fluid paths that allows a rear damming fluid BF to pass through therein.

The plurality of rear damming fluid ejection holes 501 are disposed around the mandrel bar 3, and are disposed around the hollow shell 10 which is piercing-rolled or elongation-rolled. In the present example, the rear damming fluid ejection holes 501 are formed in front ends of a plurality of rear damming fluid ejection nozzles 503. However, the rear damming fluid ejection holes 501 may be directly formed in the main body 502. In the present example, the rear damming fluid ejection nozzles 503 which are disposed around the pass line PL and the mandrel bar 3 are connected to the main body 502.

Referring to FIG. 23, the plurality of rear damming fluid ejection holes 501 face the mandrel bar 3. Therefore, when the hollow shell 10 which is pierce-rolled, or elongation-rolled passes inside of the rear outer surface damming mechanism 500, the plurality of rear damming fluid ejection holes 501 face the outer surface of the hollow shell 10.

The plurality of rear damming fluid ejection holes 501 are arranged in a circumferential direction around the mandrel bar 3. The plurality of rear damming fluid ejection holes 501 are preferably disposed at equal intervals around the mandrel bar 3. The rear outer surface damming mechanism 500 ejects the rear damming fluid BF toward a rear end of the cooling zone 32 from the rear damming fluid ejection holes 501.

When the piercing mill 100 includes the rear outer surface damming mechanism 500 having the above configuration, the following characteristic is obtained.

During piercing-rolling or elongation rolling, the outer surface cooling mechanism 400 ejects the cooling liquid CF to the outer surface portion of the hollow shell 10 in the cooling zone 32, in the outer surface of the hollow shell 10 which is piercing-rolled or elongation-rolled, and cools the hollow shell 10. At this time, there can be a case where the cooling liquid CF which is ejected to the outer surface portion of the hollow shell 10 in the cooling zone 32 flows on the outer surface after contacting the outer surface portion of the hollow shell 10, and flows out to the outer surface portion of the hollow shell 10 behind the cooling zone 32.

Thus, in the present embodiment, during piercing-rolling or elongation rolling, the rear outer surface damming mechanism 500 restrains the cooling liquid CF which contacts the outer surface portion of the hollow shell 10 in the cooling zone 32 and flows on the outer surface from contacting the outer surface portion of the hollow shell 10 which is after exiting the cooling zone 32. Specifically, in FIG. 23 and FIG. 24, the rear outer surface damming mechanism 500 ejects the rear damming fluid BF toward an outer surface portion of the hollow shell 10, which is located in a vicinity at the outlet side of the cooling zone 32. Thereby, the rear damming fluid BF dams the cooling liquid CF which contacts the outer surface portion of the hollow shell 10 in the cooling zone 32 from flowing out rearward of the cooling zone 32. In other words, the rear damming fluid BF which is ejected from the rear damming fluid ejection holes 501 plays a part of a dam (protection wall) to the cooling liquid CF which is to flow out rearward of the cooling zone 32. Therefore, the cooling liquid CF can be restrained from contacting the outer surface portion of the hollow shell 10 which is after exiting from the cooling zone 32, and a temperature variation in the axial direction of the hollow shell 10 can be further reduced.

Referring to FIG. 23, the rear damming fluid ejection holes 501 preferably eject the rear damming fluid BF diagonally forward to the outer surface portion of the hollow shell 10 at the rear end of the cooling zone 32.

In this case, during piercing-rolling and elongation rolling, the rear damming fluid BF is ejected diagonally forward, and therefore, the rear damming fluid BF forms a dam (protection wall) that extends diagonally forward to the outer surface of the hollow shell 10 from the rear damming fluid ejection holes 501. Therefore, the dam by the rear damming fluid BF dams the cooling liquid CF that contacts the outer surface portion of the hollow shell 10 in the cooling zone 32 from flowing out rearward of the cooling zone 32. Further, much of the rear damming fluid BF configuring the dam flows into the cooling zone 32 in front, after contacting the outer surface of the hollow shell 10 which is located in the vicinity of the outlet side of the cooling zone 32. Therefore, the rear damming fluid BF which is used as the dam can be restrained from contacting the outer surface portion of the hollow shell 10 which is after exiting the cooling zone 32.

The rear damming fluid BF is gas and/or a liquid. In other words, as the rear damming fluid BF, gas may be used, a liquid may be used, or both gas and a liquid may be used. Here, gas is air or inert gas, for example. Inert gas is argon gas or nitrogen gas, for example. When gas is used as the rear damming fluid BF, only air may be used, only inert gas may be used, or both air and inert gas may be used. Further, as the inert gas, only one kind of inert gas (for example, only argon gas, or only nitrogen gas) may be used, or a plurality of inert gases may be mixed and used. When a liquid is used as the rear damming fluid BF, the liquid is, for example, water or oil, and is preferably water.

A kind of the rear damming fluid BF may be a same kind as or a different kind from the kind of the cooling liquid CF and/or the front damming fluid FF. The rear outer surface damming mechanism 500 receives supply of the rear damming fluid BF from a fluid supply source not illustrated. The rear damming fluid BF which is supplied from the fluid supply source passes through the fluid path in the main body 502 of the rear outer surface damming mechanism 500 and is ejected from the rear damming fluid ejection holes 501.

Figure 25:
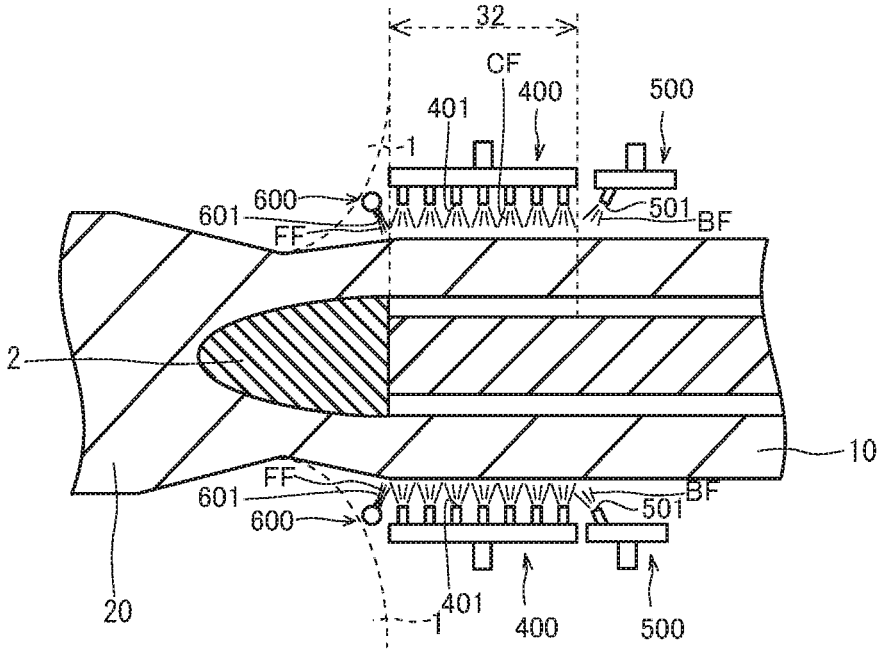
FIG. 25 is a side view of a vicinity of a skewed roll of a piercing mill including the outer surface cooling mechanism, the front outer surface damming mechanism, and the rear outer surface damming mechanism.

As illustrated in FIG. 25, the piercing mill 100 may include the outer surface cooling mechanism 400, the front outer surface damming mechanism 600, and the rear outer surface damming mechanism 500 together. In this case, not only the outer surface temperature of the hollow shell 10 can be reduced to 1000° C. or less within 15.0 seconds after the hollow shell 10 passes between the rearmost ends F of the skewed rolls 1 in the front-rear direction of the piercing mill 100, but also the cooling liquid CF which contacts the outer surface portion of the hollow shell 10 in the cooling zone 32 and bounces back can be restrained from contacting the outer surface portion of the hollow shell 10 in front and in rear of the cooling zone 32 again, during piercing-rolling or elongation rolling, by the front outer surface damming mechanism 600 and the rear outer surface damming mechanism 500.

Specifically, the front outer surface damming mechanism 600 ejects the front damming fluid FF toward the outer surface portion of the hollow shell 10 which is located at the fore end of the cooling zone 32 during piercing-rolling or during elongation rolling. Thereby, the front damming fluid FF performs a function of the dam (protection wall), and restrains the cooling liquid CF which contacts the outer surface portion of the hollow shell 10 in the cooling zone 32 and bounces back from jumping forward of the cooling zone 32.

Further, the rear outer surface damming mechanism 500 ejects the rear damming fluid BF toward the outer surface portion of the hollow shell 10 which is located at the rear end of the cooling zone. 32 during piercing-rolling or during elongation rolling. Thereby, the rear damming fluid BF performs the function of the dam (protection wall), and restrains the cooling liquid CF which contacts the outer surface portion of the hollow shell 10 in the cooling zone 32 and bounces back from jumping rearward of the cooling zone 32.

By the above configuration, when the piercing mill 100 includes the outer surface cooling mechanism 400, the front outer surface damming mechanism 600, and the rear outer surface damming mechanism 500 together, the cooling liquid CF can be restrained from contacting the outer surface portion of the hollow shell 10 in front and in rear of the cooling zone 32, and the temperature variation in the axial direction of the hollow shell 10 can be further reduced.

[Case of Including Both Inner Surface Cooling Mechanism 340 and Outer Surface Cooling Mechanism 400]

Figure 26:
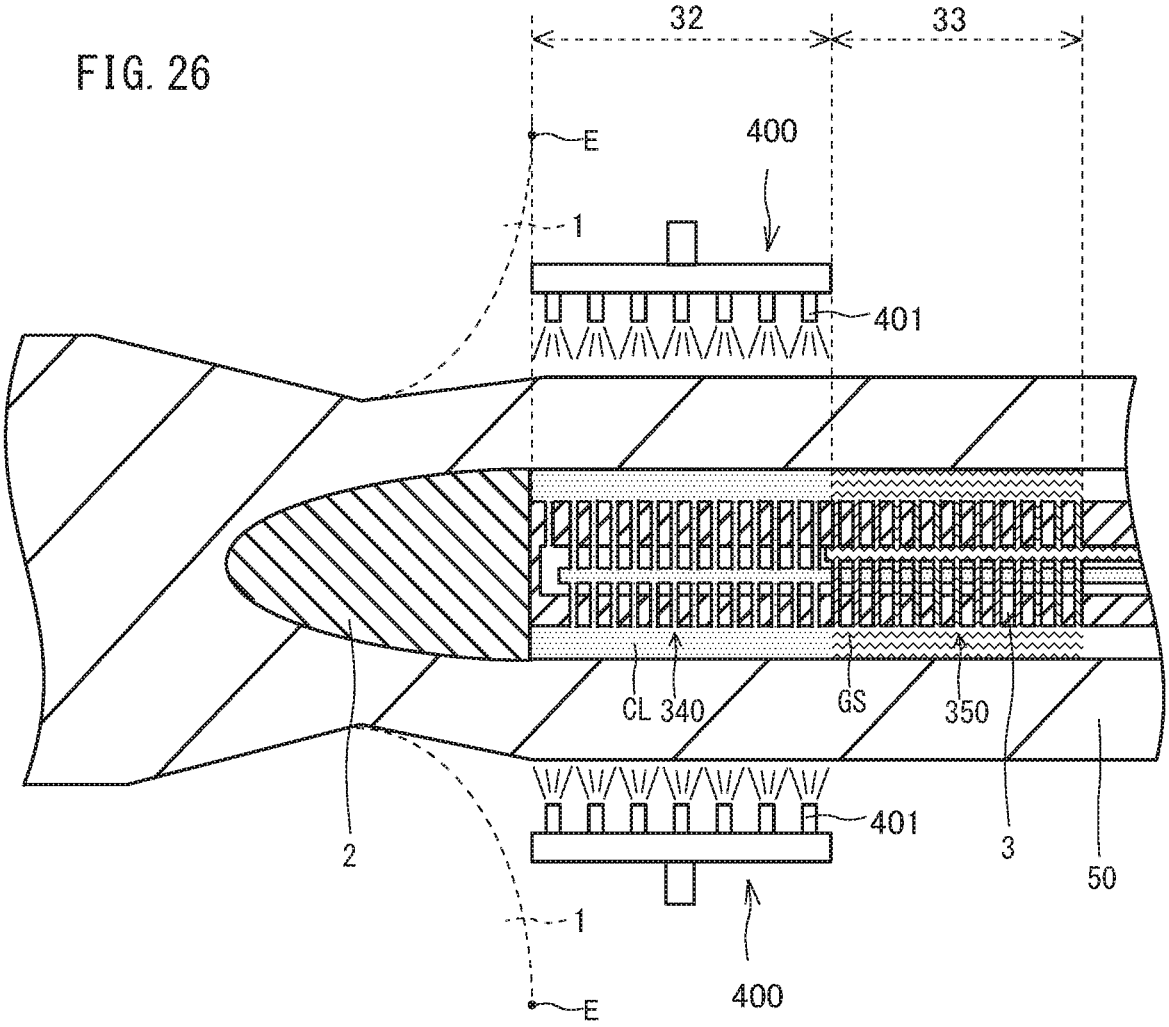
FIG. 26 is a side view of the piercing mill including the outer surface cooling mechanism and an inner surface cooling mechanism.

Further, the piercing mill 100 may include both the inner surface cooling mechanism 340 and the outer surface cooling mechanism 400. FIG. 26 is a vertical sectional view in a vicinity of the skewed rolls 1 during piercing-rolling or elongation rolling, of a case where the piercing mill 100 includes both the inner surface cooling mechanism 340 and the outer surface cooling mechanism 400.

In FIG. 26 during piercing-rolling or elongation rolling, the inner surface cooling mechanism 340 cools the inner surface portion of the hollow shell 10 in the cooling zone 32, and the outer surface cooling mechanism 400 cools the outer surface portion of the hollow shell 10 in the cooling zone 32. Therefore, cooling of the hollow shell 10 immediately after piercing-rolling or elongation rolling is completed (that is, immediately after passing through the plug 2) can be promoted. In particular, when a thick-wall seamless steel pipe (wall thickness of 30 mm or more, for example) is produced, an effective effect is obtained.

The outer surface cooling mechanism 400 cools the outer surface portion of the hollow shell 10 in the cooling zone 32 as described above. At this time, the outer surface of the hollow shell 10 during piercing-rolling or elongation rolling does not form a closed space during rolling, unlike the inner surface of the hollow shell 10. Therefore, the cooling liquid which is ejected from the outer surface cooling mechanism 400 drops downward quickly without staying on the outer surface of the hollow shell 10. Therefore, a phenomenon that the cooling liquid which is ejected from the outer surface cooling mechanism 400 enters the outer surface portion of the hollow shell 10 on the contact suppression zone 33 and stays on the outer surface portion for a long time hardly occurs. Therefore, when the outer surface portion of the hollow shell 10 in the cooling zone 32 is cooled with the outer surface cooling mechanism 400, a cooling time period by the cooling liquid in each of positions in the longitudinal direction of the hollow shell 10 is easily made constant.

Figure 27:
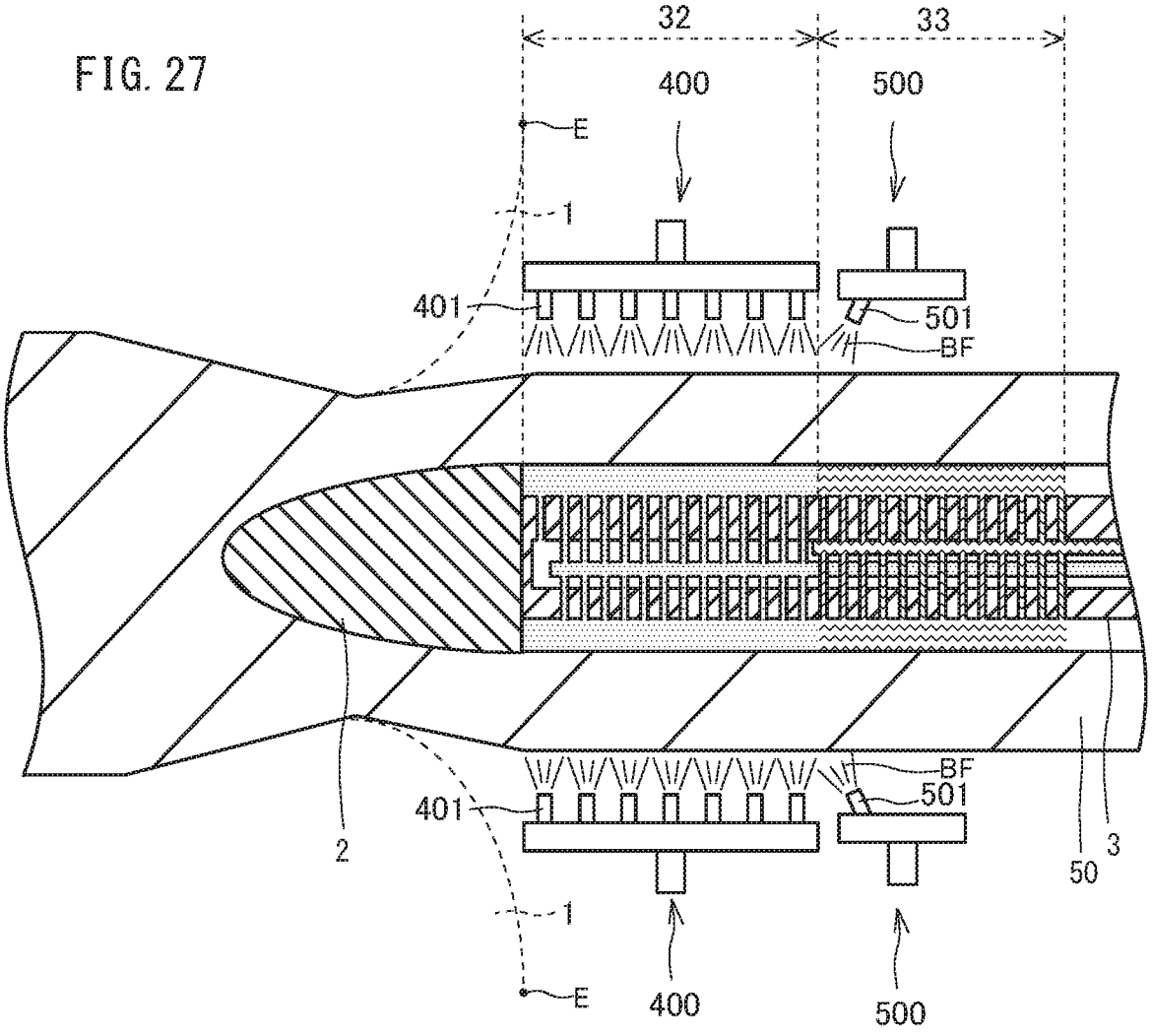
FIG. 27 is a side view of another piercing mill different from FIG. 26.

As illustrated in FIG. 27, the piercing mill 100 preferably further includes the aforementioned rear outer surface damming mechanism 500. The rear outer surface damming mechanism 500 is disposed in rear of the outer surface cooling mechanism 400 and on the contact suppression zone 33. The rear outer surface damming mechanism 500 is disposed on the outlet side of the piercing mill 100 and around the contact suppression zone 33 of the mandrel bar 3. The rear outer surface damming mechanism 500 includes the plurality of rear damming fluid ejection holes 501 which are disposed around the pass line PL. The rear outer surface damming mechanism 500 connects to the fluid supply source not illustrated via the pipe not illustrated.

During piercing-rolling or elongation rolling, the rear outer surface damming mechanism 500 ejects the rear damming fluid BF to the outer surface portion of the hollow shell 10 in the contact suppression zone 33. The ejected rear damming fluid BF restrains the cooling liquid ejected from the outer surface cooling mechanism 400 from entering the outer surface portion of the hollow shell 10 in the contact suppression zone 33, and dams the cooling liquid. Accordingly, when the outer surface portion of the hollow shell 10 in the cooling zone 32 is cooled with the outer surface cooling mechanism 400, the cooling time period in each of the positions in the longitudinal direction of the hollow shell 10 is more easily made constant.

Figure 28:
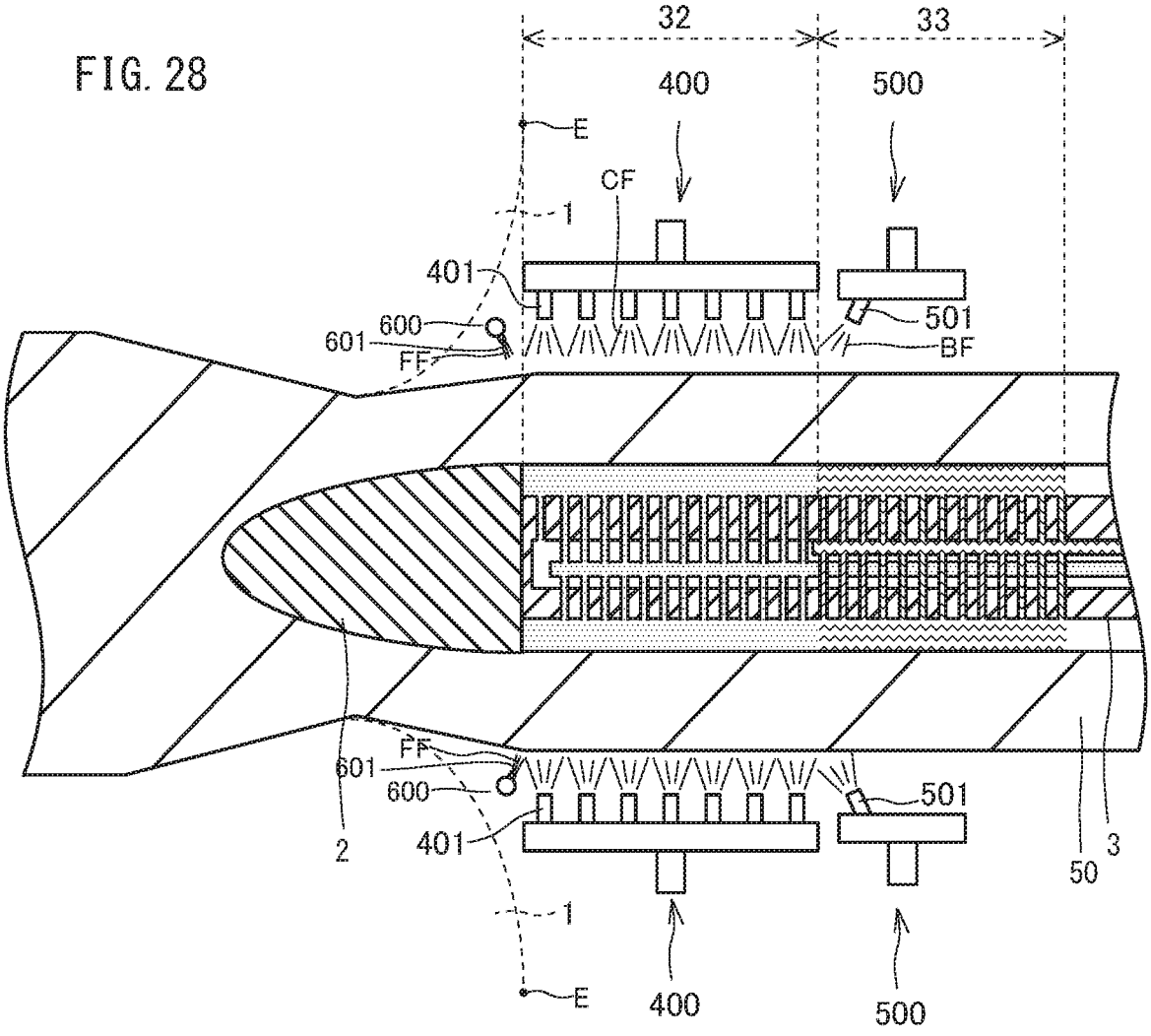
FIG. 28 is a side view of another piercing mill, which is different from FIG. 26 and FIG. 27.

As illustrated in FIG. 28, the piercing mill 100 preferably further includes the aforementioned front outer surface damming mechanism 600, with the aforementioned rear outer surface damming mechanism 500. In this case, not only the outer surface temperature of the hollow shell 10 can be reduced to 1000° C. or less within 15.0 seconds after the hollow shell 10 passes between the rearmost ends E of the skewed rolls 1 in the front-rear direction of the piercing mill 100, but also the cooling liquid CF which contacts the outer surface portion of the hollow shell 10 in the cooling zone 32 and bounces back is restrained from contacting the outer surface portion of the hollow shell 10 in front and in rear of the cooling zone 32 again during piercing-rolling or elongation rolling, by the front outer surface damming mechanism 600 and the rear outer surface damming mechanism 500. As a result, the cooling time period in each of the positions in the longitudinal direction of the hollow shell 10 is easily made constant.

[Use Patterns of Outer Surface Cooling Mechanism 400 and Inner Surface Cooling Mechanism 340]

In the cooling step immediately after rolling of the present embodiment, the outer surface temperature of the hollow shell portion may be reduced to 1000° C. or less within 15.0 seconds after passing between the roll rear ends, by cooling the hollow shell portion immediately after rolling by using only the outer surface cooling mechanism 400, or the outer surface temperature of the hollow shell portion may be reduced to 1000° C. or less within 15.0 seconds after passing between the roll rear ends, by cooling the hollow shell portion immediately after rolling by using only the inner surface cooling mechanism 340. The outer surface temperature of the hollow shell portion may be reduced to 1000° C. or less within 15.0 seconds after passing between the roll rear ends, by cooling the hollow shell portion immediately after rolling by using both the inner surface cooling mechanism 340 and the outer surface cooling mechanism 400. When cooling is performed by using only the outer surface cooling mechanism 400, the inner surface cooling mechanism 340 may not be included. Further, when cooling is performed by using only the inner surface cooling mechanism 340, the outer surface cooling mechanism 400 may not be included. Further, when the outer surface cooling mechanism 400 is used, the front outer surface damming mechanism 600 and/or the rear outer surface damming mechanism 500 may or may not be used. As described above, the inner surface damming mechanism 350 may or may not be included.

By using the piercing mill 100 having the above configuration, the pipe-making step that is the next step to the heating step, and the cooling step immediately after rolling that is the next step to the pipe-making step are carried out. When a plurality of piercing mills 100 exist in the equipment system line (for example, the equipment system lines in FIG. 7B and FIG. 7C), the pipe-making step and the cooling step immediately after rolling can be carried out in at least one of the piercing mills 100. When a plurality of piercing mills 100 exist, both the steps of the pipe-making step and the cooling step immediately after rolling may be carried out in the respective piercing mills 100. Hereinafter, the pipe-making step and the cooling step immediately after rolling will be described.

[Pipe-Making Step]

In the pipe-making step, piercing-rolling or elongation rolling is carried out by using the piercing mill 100, and a hollow shell is produced. When the piercing mill 100 is an elongator or a plug mill, the outer surface temperature of the hollow shell on the entrance side of the piercing mill 100 is 700 to 1000° C. The outer surface temperature of the hollow shell mentioned here means an average value (° C.) of the temperatures which are measured with the above described radiation thermometers in a plurality of positions in the axial direction of the main body area 10CA.

[Cooling Step Immediately after Rolling]

During piercing-rolling or elongation rolling, cooling using the cooling liquid is carried out on the hollow shell portion which passes between the rear ends E of the plurality of skewed rolls 1 in the front-back direction of the piercing mill 100 by the inner surface cooling mechanism 340 and/or the outer surface cooling mechanism 400, and the outer surface temperature of the hollow shell portion is reduced to 1000° C. or less within 15.0 seconds after the hollow shell portion passes between the rear ends E of the skewed rolls 1. Thereby, Nb carbides and the like that are produced during heating, piercing-rolling or elongation rolling can be restrained from dissolving excessively, and an effective amount of Nb carbides and the like to the pinning effect can remain. As a result, coarsening of the crystal grains of the hollow shell after being piercing-rolled or elongation-rolled by the piercing mill 100 can be suppressed.

For example, prior-austinite grain sizes are measured by the following method, with respect to the hollow shell 10 which is piercing-rolled or elongation-rolled with the piercing mill 100, and to which the cooling step immediately after rolling is carried out. In the main body area 10CA excluding the first tube end area and the second tube end area of the hollow shell 10, central positions in the axial direction, of respective zones that are divided into five in the axial direction of the hollow shell 10 are selected. In a section perpendicular to the axial direction of the hollow shell 10 in each of the selected positions, test specimens that have surfaces (observation surfaces) parallel to the axial direction of the hollow shell 10 are produced, from wall thickness central positions (central part of wall thickness) in eight positions at positions with 45° pitches around the center axis of the hollow shell 10. The observation surface is in a rectangle of 10 mm×10 mm, for example. Observation surfaces of the respective test specimens are mechanically polished. The observation surfaces after mechanical polishing are etched by using a picral (Picral) etching reagent to cause prior-austinite crystal grain boundaries in the observation surfaces to appear. Thereafter, on the observation surfaces, grain sizes of the respective prior-austinite grains are measured by the cutting method (based on the average number of intersections of grain boundaries per millimeter of test line) conforming to JIS G0551 (2013) in optional four fields of view (500 μm×500 μm per one field of view) by using an optical microscope with a magnifying power of 200. The average value of the prior-austinite grain sizes in each of the fields of view (four fields of view×eight positions×five equal parts=160 fields of view) which were measured is defined as a prior-austinite grain size (μm) of the hollow shell 10.

When the prior-austinite grain size is less than 10 m, an austinite structure before transformation is reconstructed from a crystal orientation analysis result by EBSD (Electron Backscatter Diffraction), and the prior-austinite grain size is calculated (austenite reconstruction method). Details of the austinite reconstruction method is described in "Development of Reconstruction method for Prior Austenite Microstructure Using EBSD Data of Ferrite Microstructure", HATA et al., NIPPON STEEL & SUMITOMO METAL CORPORATION Technical Report No. 404 (2016), p. 24 to p. 30 (Non Patent Literature 1). In the austinite reconstruction method, in accordance with the method proposed by Humbert et al., a relationship between parent phase austinite and ferrite variants is expressed by a rotation matrix in expression (1).

$$R_j g^{\alpha} = V_k R_i g^{\gamma} \quad (1)$$

Here, $g^{\alpha}$ is a rotation matrix expressing the crystal orientation of ferrite, and $g^{\gamma}$ is a rotation matrix expressing the crystal orientation of austinite. $V_k$ (k=1 to 24) is a transformation matrix of a crystal coordinate system from austinite to ferrite, and $R_i$ and $R_j$ (i,j=1 to 24) are rotation matrix groups of cubic symmetry.

Based on expression (1), the crystal orientation of austinite is defined by expression (2).

$$g^{\gamma} = (V_k R_i)^{-1} R_j g^{\alpha} \quad (2)$$

Since there are 24 variants of a crystallographically equivalent orientation in the Krujumov-Sachs (K-S) relationship, there are 24 options for $V_k$. If it is known in which variant transformation occurred, the orientation of austinite can be obtained from the orientations of the parent phase and production phase.

In order to specify Vk, it is necessary to examine at least three kinds of ferrite variants produced from the same austinite grains. Specifically, by comparing the crystal orientations of austinite obtained from the crystal orientations of at least three kinds of ferrite variants, the crystal orientation of the parent phase austinite can be specified as the matching orientation Specifically, by using crystal orientations $g^{\alpha 1}$ and $g^{\alpha 2}$ of different ferrite variants, an orientation difference θ of the austinites obtained by expression (3) and expression (4) is evaluated, and i and k with which the orientation difference θ is within a fixed allowable angle are obtained.

$$M^{\gamma 1-\gamma 2}(g^{\gamma 1})^{-1} g^{\gamma 2} = ((V_k R_i)^{-1} g^{\alpha 1})^{-1} (V_i R_j)^{-1} g^{\alpha 2} \quad (3)$$

$$\theta = \cos^{-1}((M_{11} + M_{22} + M_{33} - 1)/2) \quad (4)$$

As a result of the above, the austinite orientation $g^{\gamma}$ is obtained from expression (2). By this method, from the crystal orientations of the ferrite variants, the crystal orientation of austinite can be analyzed. When a ferrite variant $\alpha_1$ and a ferrite variant $\alpha_2$ have a common austinite as the parent phase, the austinite is considered as an austinite of a common crystal orientation in the case of the allowable angle θ≤degrees, because there is an error of EBSD although the allowable angle θ is ideally 0 degrees.

In the present specification, in the method of common austinite by the aforementioned method, analysis on the crystal grains which were starting points is performed with all of ferrite grains in the respective fields of view as targets. By statistically evaluating the analysis result, ferrite grains from which only one candidate of $V_k$ in expression (1) can be found are obtained. The obtained ferrite grains are specified as ferrite grains from which only one common austinite orientation can be determined.

As for the austinite orientations of the remaining ferrite grains, difference between the austinite orientations of the remaining ferrite grains and each of the orientations of the ferrite grains (referred to as the specified ferrite grains) from which the one austinite orientation can be determined is investigated, and the austinite orientations of the remaining ferrite grains are determined to be an orientation with the smallest orientation difference. Subsequently, the austinite orientations of the ferrite grains are compared with the austinite orientations of the surrounding ferrite grains, and the ferrite grains are incorporated in the prior-austinite grains with which the orientation differences are the smallest. The average grain size of the prior-austinite grains which is reconstructed by the above method is obtained by the cutting method conforming to JIS 00551 (2013) (based on the average number of intersections of the grain boundaries per millimeter of the test wire).

When the prior-austinite grain size of the hollow shell 10 was measured by the above described measurement method, the prior-austinite grain sizes of the hollow shell 10 after the cooling step immediately after rolling is 10.0 μm or less.

Figure 29:
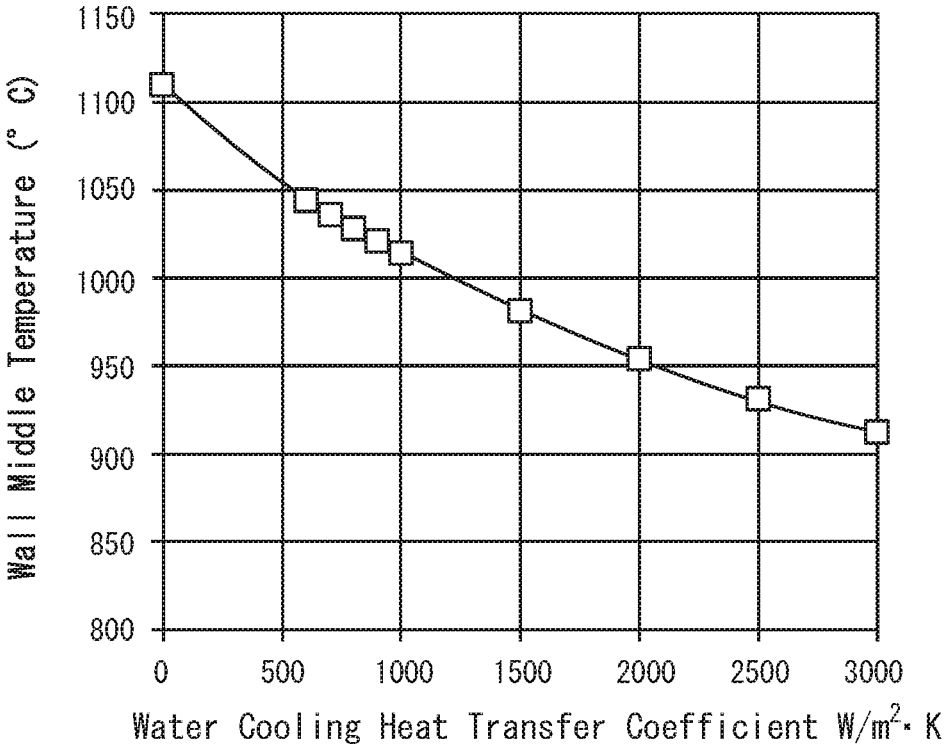
FIG. 29 is a diagram illustrating a relationship between a heat transfer coefficient during cooling time by the inner surface and outer surface cooling mechanisms and a wall middle temperature of the hollow shell, based on a simulation result.

FIG. 29 is a simulation result of a wall middle temperature of a hollow shell after a lapse of 15.0 seconds after passing between the rear ends E of the skewed rolls 1 when the hollow shell (with a diameter of 430 mm, and a wall thickness of 30 mm) was produced by performing piercing-rolling on the Nb-containing steel material having the aforementioned chemical composition, by using the piercing mill 100. FIG. 29 was obtained by heat transfer calculation by the FEM analysis. Specifically, production conditions were as follows. The heating temperature for the Nb-containing steel material having the above described chemical composition was 950° C. The piercing ratio was 2.1, and the roll peripheral speed was 4000 mm/second. The roll diameter was 1400 mm. The hollow shell was cooled for 10.0 seconds by the cooling liquid (water) from both the outer surface and the inner surface of the hollow shell immediately after piercing-rolling. The wall middle temperature of the hollow shell after being further air-cooled for 5.0 seconds after cooling by the cooling liquid (that is, after 15.0 seconds after passing between the rearmost ends E of the skewed rolls 1) was obtained. The heat transfer calculation was performed by using the conventional code DEFORM with a two-dimensional axially symmetrical model as the model of the FEM analysis. Specifically, the temperature distribution immediately after piercing-rolling was calculated with the deformation-thermal conduction FEM analysis model, and based on the result of the calculation, the thermal conduction FEM analysis was carried out by using the conventional code DEFORM.

Referring to FIG. 29, when the thermal transfer coefficient during cooling by the cooling liquid is preferably made 1000 $W/m^2 \cdot K$ or more, and when the hollow shell has a wall thickness of 5 to 50 mm, the wall middle temperature of the hollow shell can be reduced to 1050° C. or less within 15.0 seconds after passing between the rearmost ends E of the skewed rolls 1.

Figure 30:
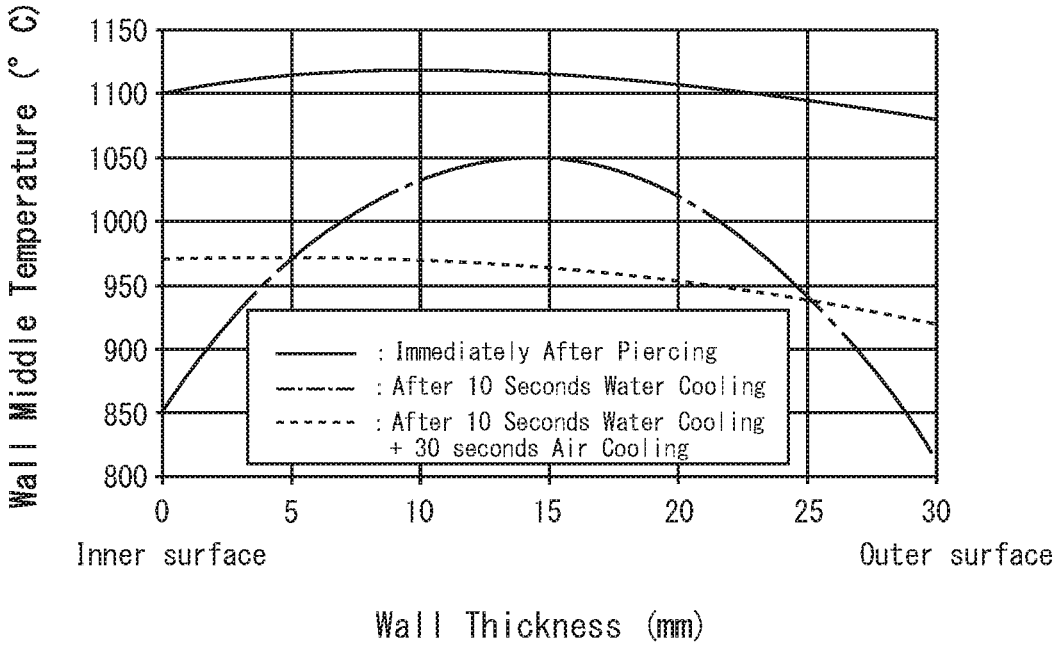
FIG. 30 is a diagram of a simulation result illustrating a temperature distribution in a wall thickness direction in a case where an inner surface and an outer surface of the hollow shell are cooled by using the piercing mill illustrated in FIG. 26.

FIG. 30 is a simulation result illustrating a temperature distribution in the wall thickness direction, when the hollow shell 10 (430 mm in diameter, 30 mm in wall thickness) was produced by performing piercing-rolling by using the piercing mill 100, on the Nb-containing steel material having the aforementioned chemical composition. FIG. 30 was obtained by heat transfer calculation by the FEM analysis. Specifically, the production conditions were as follows. The heating temperature for the Nb-containing steel material having the above described chemical composition was 950° C. The piercing ratio was 2.1, and the roll peripheral speed was 4000 mm/second. The roll diameter was 1400 mm, and the heat transfer coefficient during cooling by the cooling liquid (water) was 1000 W/M K. The hollow shell was cooled for 10.0 seconds by the cooling liquid (water) from both the outer surface and the inner surface of the hollow shell immediately after piercing-rolling, and thereafter, was allowed to cool. The wall middle temperature distributions in the wall thickness direction were obtained immediately after piercing-rolling, after 10.0 seconds immediately after piercing-rolling, and after 40.0 seconds (water cooling for 10.0 seconds+air-cooling for 30.0 seconds) immediately after piercing-rolling, respectively.

Referring to FIG. 30, the wall middle temperature was reduced to 1050° C. or less by water-cooling the inner surface and the outer surface for 10.0 seconds. Subsequently, after 40.0 seconds immediately after piercing-rolling, the temperature distribution in the wall thickness direction became substantially uniform. From the above, it is conceivable that cooling on both the inner surface and the outer surface is preferably effective. However, the cooling conditions are not specially limited, as long as the outer surface temperature of the hollow shell portion is reduced to 1000° C. or less within 15.0 seconds after the hollow shell portion passes between the roll rear ends E even by carrying out cooling on only the inner surface or cooling on only the outer surface by adjusting the heat transfer coefficient (a flow rate or the like of the cooling liquid) during cooling by the cooling liquid.

The above described cooling step immediately after rolling can exhibit an effect specially effectively when the maximum diameter (roll diameter of the gorge portion) of the skewed roll 1 is 1200 to 1500 mm, the piercing ratio or the elongation ratio defined by the following expression is 1.2 to 40, and the roll peripheral speed is 2000 to 6000 mm/second, for example. A preferable outside diameter of the hollow shell which is produced is 250 to 500 mm, and a preferable wall thickness is 5.0 to 50.0 mm.

Elongation ratio=hollow shell length after elongation rolling/hollow shell length before elongation rolling

[Other Steps]

The production method of a seamless steel pipe of the present embodiment may include other steps than the above described steps. For example, the production method of a seamless steel pipe of the present embodiment may include an elongation rolling step and a sizing step, after the cooling step immediately after rolling. In the elongation rolling step, a hollow shell is elongation-rolled by an elongation rolling mill such as a mandrel mill, for example. In the sizing step, a hollow shell is subjected to sizing rolling by a sizing mill such as a sizer, and a stretch reducer, for example.

The production method of a seamless steel pipe of the present embodiment may include a quenching step and a temper step.

[Quenching Step]

In the quenching step, a hollow shell having an outer surface temperature of the $A_3$ transformation point or more (the outer surface temperature of the hollow shell after the pipe-making step is the $A_{r3}$ transformation point or more, or when a supplementary heating step and a reheating step are carried, the outer surface temperature of the hollow shell is the $A_{c3}$ transformation point or more) is rapidly cooled and quenched. A preferable outer surface temperature (quenching temperature) of the hollow shell at the start of rapid cooling in the quenching step is the $A_3$ transformation point (the $Ar_3$ transformation point or the $Ac_3$ transformation point) to 1000° C. Here, the outer surface temperature of the hollow shell at the start of rapid cooling is an average value of the outer surface temperatures of the main body area 10CA. An average cooling speed CR in a period until the outer surface temperature of the hollow shell reaches 300° C. from the outer surface temperature of the hollow shell at the start of rapid cooling in the quenching step is preferably made 15° C./second or more. A lower limit of the average cooling speed CR is preferably 17° C./second, and is more preferably 19° C./second. A rapid cooling method in the quenching step is preferably water-cooling.

When so-called inline quenching is carried out, the quenching step is carried out by a water-cooling device that is on a pipe-making line and is disposed downstream of the elongation rolling mill or the sizing mill, for example. The water-cooling device includes, for example, a laminar water flow device, and a jet water flow device. The laminar water flow device pours water to the hollow shell from above. At this time, the water that is poured to the hollow shell forms a water flow in a laminar shape. The jet water flow device ejects a jet water flow to the inside of the hollow shell from the end of the hollow shell. The water-cooling device may be other devices than the laminar water flow device and jet water flow device described above. The water-cooling device may be a water tank, for example. In this case, the hollow shell is submerged in the water tank and is cooled. The water-cooling device may be only a laminar water flow device.

When so-called offline quenching is carried out, the quenching step is carried out by a water-cooling device that is disposed outside the equipment system line, for example. The water-cooling device is similar to the water-cooling device which is used in inline quenching. When offline quenching is carried out, reverse transformation can be used, and therefore as compared with the case where only inline quenching is carried out, the crystal grains of the seamless steel pipe are further refined.

[Temper Step]

The hollow shell which is rapidly cooled and quenched in the quenching step is tempered and is made a seamless steel pipe. A temper temperature is the $Ac_1$ transformation point or less, and is more preferably 650° C. to the $Ac_1$ transformation point. The temper temperature is adjusted based on desired mechanical properties. The temper temperature (° C.) means an in-furnace temperature in a heat treatment furnace used in the temper step. In the temper step, the outer surface temperature of the hollow shell becomes the same as the temper temperature (in-furnace temperature).

By the above steps, the seamless steel pipe according to the present embodiment is produced.

Example

The Nb-containing steel material having the chemical composition shown in Table 1 was prepared.

TABLE 1

| | Chemical Compostion (Mass %, Balance Being Fe and impurities) | | | | | | | | | | | | | | |
|---|---|---|---|---|---|---|---|---|---|---|---|---|---|---|---|
| Steel Grade | C | Si | Mn | P | S | Al | N | Cr | Mo | Nb | B | Ti | V | Ca | REM |
| A | 0.26 | 0.28 | 0.46 | 0.009 | 0.001 | 0.035 | 0.004 | 1.09 | 0.50 | 0.03 | 0.0005 | 0.026 | 0 | 0 | 0 |
| B | 0.27 | 0.28 | 0.49 | 0.008 | 0.002 | 0.027 | 0.003 | 1.01 | 0.49 | 0.02 | 0.0012 | 0.017 | 0 | 0.0014 | 0 |
| C | 0.27 | 0.33 | 0.42 | 0.008 | 0.002 | 0.028 | 0.003 | 1.00 | 0.30 | 0.02 | 0.0012 | 0.012 | 0.07 | 0.0010 | 0.001 |

Piercing-rolling or elongation rolling was carried out on round billets of respective test numbers by using the piercing mill having the configuration illustrated in FIG. 8. Sizes of the Nb-containing steel materials of the respective test numbers are as shown in Table 2.

TABLE 2

| Test number | Material Type | Steel Grade Used | Material Size: Outside Diameter (mm) | Material Size: Inside Diameter (mm) | Material Size: Length (mm) | Blank Tube Size After Rolling: Outside Diameter (mm) | Blank Tube Size After Rolling: Length (mm) | Blank Tube Size After Rolling: Wall Thickness (mm) | Heating Temperature (° C.) | Roll Maximum Diameter (mm) | Roll Peripheral Speed (mm/sec) | Roll Rotational Speed (rpm) | Piercing Ratio | Water-cooled Location | Outer Surface temperature (° C.) After 15.0 Seconds | Prior γ Grain Sizes (μm) |
|---|---|---|---|---|---|---|---|---|---|---|---|---|---|---|---|---|
| 1 | Round Billet | A | 70 | 0 | 400 | 92.3 | 840 | 6.8 | 950 | 410 | 1288 | 60.0 | 2.10 | None | 1040 | 18.5 |
| 2 | Round Billet | B | 70 | 0 | 400 | 93.1 | 820 | 6.9 | 950 | 410 | 1288 | 60.0 | 2.05 | None | 1030 | 21.7 |
| 3 | Round Billet | A | 70 | 0 | 400 | 94.1 | 936 | 5.9 | 950 | 410 | 1288 | 60.0 | 2.34 | None | 1060 | 19.3 |
| 4 | Round Billet | C | 70 | 0 | 400 | 93.3 | 948 | 5.9 | 950 | 410 | 1288 | 60.0 | 2.37 | None | 1010 | 20.3 |
| 5 | Round Billet | A | 70 | 0 | 400 | 93.6 | 1047 | 5.3 | 950 | 410 | 1288 | 60.0 | 2.62 | None | 1050 | 24.2 |
| 6 | Round Billet | B | 70 | 0 | 400 | 93.5 | 1048 | 5.3 | 950 | 410 | 1288 | 60.0 | 2.62 | None | 1030 | 22.6 |
| 7 | Blank Tube | A | 65 | 21 | 400 | 93.1 | 1062 | 4.0 | 950 | 410 | 1288 | 60.0 | 2.65 | None | 1090 | 20.8 |
| 8 | Blank Tube | A | 65 | 21 | 600 | 78.0 | 914 | 9.0 | 950 | 410 | 1288 | 60.0 | 1.52 | None | 1020 | 19.6 |
| 9 | Round Billet | A | 225 | 0 | 3000 | 340.0 | 7788 | 15.0 | 950 | 1400 | 3958 | 54.0 | 2.60 | Outer Surface And Inner Surface | 940 | 6.2 |
| 10 | Round Bitter | A | 310 | 0 | 3000 | 429.9 | 8811 | 20.0 | 950 | 1400 | 3958 | 54.0 | 2.94 | Outer Surface And Inner Surface | 975 | 7.1 |
| 11 | Round Billet | A | 310 | 0 | 4000 | 432.0 | 7968 | 30.0 | 950 | 1400 | 3958 | 54.0 | 1.99 | Outer Surface And Inner Surface | 980 | 7.9 |
| 12 | Round Bitter | A | 310 | 0 | 4000 | 421.9 | 5181 | 50.0 | 950 | 1400 | 3958 | 54.0 | 1.30 | Outer Surface | 940 | 8.0 |
| 13 | Blank Tube | A | 310 | 80 | 4000 | 420.0 | 4849 | 0 | 950 | 1400 | 3958 | 54.0 | 1.21 | Outer Surface | 930 | 8.0 |
| 14 | BlankCube | A | 310 | 80 | 4000 | 431.0 | 7456 | 30.0 | 950 | 1400 | 3958 | 54.0 | 1.86 | Outer Surface And inner Surface | 990 | 7.5 |
| 15 | Blank Tube | A | 65 | 21 | 600 | 93.0 | 1100 | 6.0 | 950 | 410 | 1288 | 60.0 | 1.83 | Outer Surface And Inner Surface | 979 | 7.0 |
| 16 | Blank Tube | B | 65 | 21 | 600 | 93.0 | 1100 | 6.0 | 900 | 410 | 1288 | 60.0 | 1.83 | Inner surface | 955 | 7.7 |

Specifically, in test numbers 1 to 6 and 9 to 12, the hollow shells of the sizes shown in Table 2 were produced by performing piercing-rolling on the Nb-containing steel materials which were round billets, by using a piercer as the piercing mill. The roll maximum diameters (mm), the roll peripheral speeds (mm/second) during piercing-rolling, the roll rotational speeds (rpm) during piercing-rolling, and the piercing ratios were as shown in Table 2.

In test numbers 7, 8, 15 and 16, the hollow shells of the sizes shown in Table 2 were produced by performing elongation-rolling on the Nb-containing steel materials that were the hollow shells, with an elongator as the piercing mill. The roll maximum diameters (mm), the roll peripheral speeds (mm/second) during piercing-rolling, the roll rotational speeds (rpm) during piercing-rolling, and the piercing ratios were as shown in Table 2.

During piercing-rolling or elongation rolling, the outer surface temperatures of the hollow shell portions after 15.0 seconds after passing between the rear ends E of the rolls were measured. Specifically, the outer surface temperatures of the main body area 10CA were measured by radiation thermometers, in the position after 15.0 seconds after passing between the roll rearmost ends E, and the average value thereof was defined as the outer surface temperature (° C.) after 15 seconds. By the above production method, the seamless steel pipes (hollow shells) were produced.

In test numbers 1 to 8, the seamless steel pipes were produced by carrying out piercing-rolling by using the conventional piercing mill (piercing mill that does not include the inner surface cooling mechanism 340 and the outer surface cooling mechanism 400) ("None" is written in the "water-cooled location" column in Table 2). In test numbers 9 to 11, and 14 and 15, seamless steel pipes were produced by carrying out piercing-rolling by using the piercing mill having the configuration illustrated in FIG. 26 ("outer surface and inner surface" is written in the "water-cooled location" column in Table 2). In test number 12 and 13, seamless steel pipes were produced by carrying out piercing-rolling by using the piercing mill having the configuration illustrated in FIG. 19 ("outer surface" is written in the "water-cooled location" column in Table 2). In test number 16, a seamless steel pipe was produced by carrying out piercing-rolling by using the piercing mill having the configuration illustrated in FIG. 15 ("inner surface" is written in the "water-cooled location" column in Table 2).

With respect to the hollow shells of the respective test numbers which were produced, the prior-austinite grain sizes were measured by the aforementioned method. The obtained result is shown in Table 2.

Referring to Table 2, in test numbers 1 to 8, the cooling step immediately after rolling was not carried out. Therefore, the outer surface temperatures after 15 seconds all became more than 1000° C. As a result, the prior-austinite grain sizes of the produced hollow shells were all 18.0 μm or more.

On the other hand, in test numbers 9 to 16, the outer surface temperatures after 15.0 seconds after the cooling step immediately after rolling was carried out all became 1000° C. or less. Therefore, the prior-austinite grain sizes of the produced hollow shells were all 10.0 μm or less and fine.

The embodiment of the present invention is described thus far. However, the aforementioned embodiment is only illustration for carrying out the present invention. Accordingly, the present invention is not limited to the aforementioned embodiment, but the aforementioned embodiment can be carried out by being properly changed within the range without departing from the gist of the present invention.

REFERENCE SIGNS LIST

1 Roll 2 Plug 3 Mandrel bar 100 Piercing mill 340 Inner surface cooling mechanism 400 Outer surface cooling mechanism

The invention claimed is:

1. A production method of a seamless steel pipe, comprising:

a heating step of heating an Nb-containing steel material to 800 to 1030° C., the Nb-containing steel material consisting of in mass %, C: 0.21 to 0.35%, Si: 0.10 to 0.50%, Mn: 0.05 to 1.00%, P: 0.025% or less, S: 0.010% or less, Al: 0.005 to 0.100%, N: 0.010% or less Cr: 0.05 to 1.50%, Mo: 0.10 to 1.50%, Nb: 0.01 to 0.05%, B: 0.0003 to 0.0050%, Ti: 0.002 to 0.050%, V: 0 to 0.30%, Ca: 0 to 0.0050%, rare earth metal: 0 to 0.0050%, and the balance being Fe and impurities;

a pipe-making step of producing a hollow shell by performing piercing-rolling or elongation-rolling on the Nb-containing steel material, by using a piercing mill, the piercing mill comprising:

a plurality of skewed rolls that are disposed around a pass line on which the Nb-containing steel material passes, a plug that is disposed between the plurality of skewed rolls and on the pass line, and a mandrel bar that extends rearward of the plug along the pass line from a rear end of the plug; and a cooling step immediately after rolling, of carrying out cooling by using a cooling liquid on a hollow shell portion that passes between rear ends of the plurality of skewed rolls, in the hollow shell, so as to reduce an outer surface temperature of the hollow shell portion to 700 to 1000° C. within 15.0 seconds after the hollow shell portion passes between the rear ends of the plurality of skewed rolls wherein in the cooling step immediately after rolling, the outer surface temperature of the hollow shell portion is reduced to 700 to 1000° C. within 15.0 seconds after the hollow shell portion passes between the rear ends of the plurality of skewed rolls, by ejecting the cooling liquid toward an outer surface and/or an inner surface of the hollow shell portion that passes between the rear ends of the plurality of skewed rolls, wherein the piercing mill includes an outer surface cooling mechanism that is disposed around the mandrel bar behind the plurality of skewed rolls, and includes a plurality of outer surface cooling liquid ejection holes capable of ejecting the cooling liquid toward an outer surface of the hollow shell during piercing-rolling or elongation rolling, and in the cooling step immediately after rolling, the outer surface of the hollow shell portion that passes between the rear ends of the plurality of skewed rolls is cooled by ejecting the cooling liquid from the outer surface cooling mechanism to reduce the outer surface temperature of the hollow shell portion to 700 to 1000° C. within 15.0 seconds after the hollow shell portion passes between the rear ends of the plurality of skewed rolls, wherein the outer surface cooling mechanism cools the outer surface of the hollow shell portion that passes in a cooling zone having a specific length in an axial direction of the mandrel bar, the piercing mill further includes a front outer surface damming mechanism that is disposed around the mandrel bar behind the plug and in front of the outer surface cooling mechanism, and in the cooling step immediately after rolling, wherein the cooling liquid is restrained from flowing to the outer surface of the hollow shell which is before entering the cooling zone by the front outer surface damming mechanism, when the hollow shell is being cooled by the outer surface cooling mechanism, and wherein the front outer surface damming mechanism includes a plurality of front damming fluid ejection holes that are disposed around the mandrel bar, and eject a front damming fluid toward the outer surface of the hollow shell, and in the cooling step immediately after rolling, the cooling liquid is dammed from flowing to the outer surface of the hollow shell that is before entering the cooling zone, by ejecting the front damming fluid toward an upper portion of the outer surface of the hollow shell that is located in a vicinity of an entrance side of the cooling zone, from the front outer surface damming mechanism, when the hollow shell is being cooled by the outer surface cooling mechanism.

2. The production method of a seamless steel pipe according to claim 1, wherein the outer surface cooling mechanism cools the outer surface of the hollow shell portion that passes in a cooling zone having a specific length in an axial direction of the mandrel bar, the piercing mill further comprises a rear outer surface damming mechanism that is disposed around the mandrel bar behind the plug and behind the outer surface cooling mechanism, and in the cooling step immediately after rolling, the rear outer surface damming mechanism restrains the cooling liquid from contacting an outer surface portion of the hollow shell that is located behind the cooling zone, when the outer surface cooling mechanism is cooling the hollow shell.

3. The production method of a seamless steel pipe according to claim 2, wherein the rear outer surface damming mechanism includes a plurality of rear damming fluid ejection holes that are disposed around the mandrel bar, and eject a rear damming fluid toward the outer surface of the hollow shell, and in the cooling step immediately after rolling, the rear outer surface damming mechanism dams the cooling liquid from flowing to an upper portion of the outer surface of the hollow shell that is after exiting the cooling zone, by ejecting the rear damming fluid toward the upper portion of the outer surface of the hollow shell that is located in a vicinity of an outlet side of the cooling zone, when the outer surface cooling mechanism is cooling the hollow shell.

4. The production method of a seamless steel pipe according to claim 1, wherein the mandrel bar comprises a bar main body, a cooling liquid flow path that is formed in the bar main body, and allows the cooling liquid to pass inside, and an inner surface cooling mechanism that is disposed in a cooling zone that has a specific length in an axial direction of the mandrel bar, and is located in a fore end portion of the mandrel bar, in the bar main body, and cools an inner surface of the hollow shell advancing in the cooling zone, by ejecting the cooling liquid that is supplied from the cooling liquid flow path toward an outer portion of the bar main body during piercing-rolling or elongation rolling, and in the cooling step immediately after rolling, the inner surface of the hollow shell portion that passes between the rear ends of the plurality of skewed rolls is cooled by ejecting the cooling liquid from the inner surface cooling mechanism to reduce the outer surface temperature of the hollow shell portion to 700 to 1000° C. within 15.0 seconds after the hollow shell portion passes between the rear ends of the plurality of skewed rolls.

5. The production method of a seamless steel pipe according to claim 1, wherein the mandrel bar comprises a bar main body, a cooling liquid flow path that is formed in the bar main body, and allows the cooling liquid to pass inside, and an inner surface cooling mechanism that is disposed in a cooling zone that has a specific length in an axial direction of the mandrel bar, and is located in a fore end portion of the mandrel bar, and cools an inner surface of the hollow shell advancing in the cooling zone, by ejecting the cooling liquid that is supplied from the cooling liquid flow path toward an outer portion of the bar main body during piercing-rolling or elongation rolling, and in the cooling step immediately after rolling, the outer surface and the inner surface of the hollow shell portion that passes between the rear ends of the plurality of skewed rolls are cooled by ejecting the cooling liquid from the outer surface cooling mechanism, and ejecting the cooling liquid from the inner surface cooling mechanism to reduce the outer surface temperature of the hollow shell portion to 700 to 1000° C. within 15.0 seconds after the hollow shell portion passes between the rear ends of the plurality of skewed rolls.

6. The production method of a seamless steel pipe according to claim 4, wherein the mandrel bar further comprises an inner surface damming mechanism that is disposed behind the cooling zone adjacently to the cooling zone, and restrains the cooling liquid that is ejected to the outer portion of the bar main body from contacting the inner surface of the hollow shell that is after exiting the cooling zone, during piercing-rolling or elongation rolling, and in the cooling step immediately after rolling, the inner surface of the hollow shell portion in the cooling zone is cooled by ejecting the cooling liquid from the inner surface cooling mechanism, and the cooling liquid is restrained from contacting the inner surface of the hollow shell that is after exiting the cooling zone by the inner surface damming mechanism.

7. The production method of a seamless steel pipe according to claim 5, wherein the mandrel bar further comprises an inner surface damming mechanism that is disposed behind the cooling zone adjacently to the cooling zone, and restrains the cooling liquid that is ejected to the outer portion of the bar main body from contacting the inner surface of the hollow shell that is after exiting the cooling zone, during piercing-rolling or elongation rolling, and in the cooling step immediately after rolling, the inner surface of the hollow shell portion in the cooling zone is cooled by ejecting the cooling liquid from the inner surface cooling mechanism, and the cooling liquid is restrained from contacting the inner surface of the hollow shell that is after exiting the cooling zone by the inner surface damming mechanism.

8. The production method of a seamless steel pipe according to claim 6, wherein the mandrel bar further comprises a compression gas flow path that is formed in the bar main body, and allows compression gas to pass through, the inner surface damming mechanism comprises a plurality of compression gas ejection holes that are arranged in a circumferential direction, or in a circumferential direction and an axial direction of the bar main body, and eject the compression gas that is supplied from the compression gas flow path, in a contact suppression zone that is disposed behind the cooling zone adjacently to the cooling zone, and in the cooling step immediately after rolling, the cooling liquid is restrained from flowing to the inner surface of the hollow shell portion that exits the cooling zone and enters the contact suppression zone, by ejecting the compression gas from the inner surface damming mechanism.

9. The production method of a seamless steel pipe according to claim 7, wherein the mandrel bar further comprises a compression gas flow path that is formed in the bar main body, and allows compression gas to pass through, the inner surface damming mechanism comprises a plurality of compression gas ejection holes that are arranged in a circumferential direction, or in a circumferential direction and an axial direction of the bar main body, and eject the compression gas that is supplied from the compression gas flow path, in a contact suppression zone that is disposed behind the cooling zone adjacently to the cooling zone, and in the cooling step immediately after rolling, the cooling liquid is restrained from flowing to the inner surface of the hollow shell portion that exits the cooling zone and enters the contact suppression zone, by ejecting the compression gas from the inner surface damming mechanism.

10. The production method of a seamless steel pipe according to claim 1, wherein the piercing mill is a piercer, in the pipe-making step, the hollow shell is produced by performing piercing-rolling on the Nb-containing steel material by using the piercer, and in the cooling step immediately after rolling, the outer surface temperature of the hollow shell portion is reduced to 800 to 1000° C. within 15.0 seconds after the hollow shell portion passes between the rear ends of the plurality of skewed rolls, by carrying out cooling by using the cooling liquid on the hollow shell portion that passes between the rear ends of the plurality of skewed rolls, in the hollow shell.

11. The production method of a seamless steel pipe according to claim 1, wherein the piercing mill is an elongator, in the pipe-making step, a hollow shell that is the Nb-containing steel material is elongation-rolled by using the elongator, and in the cooling step immediately after rolling, the outer surface temperature of the hollow shell portion is reduced to 700 to 1000° C. within 15.0 seconds after the hollow shell portion passes between the rear ends of the plurality of skewed rolls by carrying out cooling by using the cooling liquid on the hollow shell portion that passes between the rear ends of the plurality of skewed rolls, in the hollow shell.

12. The production method of a seamless steel pipe according to claim 1, further comprising:

a quenching step of carrying out quenching at a temperature of an $A_3$ transformation point or more on the hollow shell after the cooling step immediately after rolling; and a temper step of carrying out temper at a temperature of an $A_{c1}$ transformation point or less on the hollow shell after the quenching step.

* * * * *